US012767398B2

(12) United States Patent
Gebbink et al.

(10) Patent No.: US 12,767,398 B2
(45) Date of Patent: Oct. 20, 2026

(54) SEALING UNIT FOR A LIQUID CONTAINER

(71) Applicant: SMARTSEAL AS, Stavanger (NO)

(72) Inventors: Jeroen Gerrit Anton Gebbink, Helmond (NL); Rune Kristian Knutsen, Hundvaag (NO)

(73) Assignee: SmartSeal AS, Stavanger (NO)

( * ) Notice: Subject to any disclaimer, the term of this patent is extended or adjusted under 35 U.S.C. 154(b) by 0 days.

(21) Appl. No.: 19/109,865

(22) PCT Filed: Apr. 17, 2023

(86) PCT No.: PCT/EP2023/059937
§ 371 (c)(1),
(2) Date: Mar. 7, 2025

(87) PCT Pub. No.: WO2024/051968
PCT Pub. Date: Mar. 14, 2024

(65) Prior Publication Data

US 2026/0084868 A1 Mar. 26, 2026

(30) Foreign Application Priority Data

Sep. 9, 2022 (NL) ..... 2032997

(51) Int. Cl.
*B65D 47/24* (2006.01)
*B65D 47/32* (2006.01)

(52) U.S. Cl.
CPC ..... *B65D 47/248* (2013.01); *B65D 47/32* (2013.01)

(58) Field of Classification Search
CPC ..... B65D 47/32; B65D 47/248
See application file for complete search history.

(56) References Cited

U.S. PATENT DOCUMENTS 4,324,239 A 4/1982 Gordon et al.
5,573,516 A 11/1996 Tyner
(Continued)

FOREIGN PATENT DOCUMENTS

AU 200044381 A1 11/2000
AU 775552 B2 8/2004
(Continued)

OTHER PUBLICATIONS

International Searching Authority; International Search Report, Written Opinion of the International Searching Authority, and Notification of Transmittal of the International Search Report and the Written Opinion of the International Searching Authority, or the Declaration for International application No. PCT/EP2023/059937; mailing date Jul. 10, 2023.

*Primary Examiner* — Jeremy Carroll
(74) *Attorney, Agent, or Firm* — McDonnell Boehnen Hulbert & Berghoff LLP

(57) ABSTRACT

Sealing unit for selectively sealing and opening a container liquid opening in a liquid container for holding a liquid. The sealing unit comprises a tubular element comprising a liquid passage and a valve inside the passage. The valve comprises a tubular valve portion axially movable inside the passage between closed and open positions, and a valve skirt portion comprising a flexible skirt part configured to bend when the tubular valve portion is moved from the closed to open position under influence of an external axial force and to urge the tubular valve portion from the open to the closed position when the force is removed or reduced. The tubular element further comprises an air flow opening arranged to be covered by the valve skirt portion when the tubular valve portion is in the closed position and to be left open when the tubular valve portion is in the open position.

22 Claims, 16 Drawing Sheets

(56) References Cited

U.S. PATENT DOCUMENTS

| | | | | |
|---|---|---|---|---|
| 5,609,195 | A * | 3/1997 | Stricklin | F16L 37/28 141/351 |
| 6,213,351 | B1 * | 4/2001 | Stoneberg | B65D 50/061 222/525 |
| 2011/0042421 | A1 * | 2/2011 | Smith | B65D 77/067 222/518 |
| 2011/0155750 | A1 * | 6/2011 | Bernstein | A45F 3/16 220/714 |

FOREIGN PATENT DOCUMENTS

| | | | | |
|---|---|---|---|---|
| EP | 1240916 | A1 | 9/2002 | |
| GB | 1269726 | A | 4/1972 | |
| WO | 00/66448 | A1 | 11/2000 | |
| WO | WO-2020260709 | A1 * | 12/2020 | B65D 47/248 |

* cited by examiner

SEALING UNIT FOR A LIQUID CONTAINER

FIELD OF DISCLOSURE

The present disclosure relates to sealing unit for selectively sealing and opening a container liquid opening in a liquid container for holding a liquid. The disclosure also relates to a sealing unit activation unit for selectively operating a sealing unit, to an assembly of a sealing unit and a container, to the use of a sealing unit and/or a sealing unit activation unit, and to a method of selectively sealing and opening a container liquid opening in a liquid container provided with a sealing unit.

BACKGROUND

Liquid containers are in common use in various lines of work, such as food service and medical care, as well in the home. Liquid containers may be embodied in a wide variety, ranging—for instance—from soft-walled containers such as (spouted) pouches to hard-walled container such as cans, canisters, etc.

Liquid containers in general may contain parts made of multiple types of materials, for example metal and plastic or multiple different kinds of plastic. Different parts may have different degrees of durability, and depending on their location and role, may be subject to different amounts of wear and tear.

Liquid containers are typically supplied full and used until they are empty, and therefore have a limited lifespan in use. However, at least some of their parts have a long technical lifespan, so that their use contributes to the accumulation of waste. This waste is often difficult to recycle because of the plurality of materials used. It would be preferable to provide long-lifespanned, easily recyclable, and/or reusable containers.

For providing reusable liquid containers it is preferable that the container may be filled and/or refilled via the same opening which is used to dispense liquid. In order to enable this a male-female connection may be used.

Such a system is known from Australian patent AU 775552 B2. Herein a rigid male element and a rigid female element may be moved relative to each other between two extreme positions. The male element may be coupled to a rigid plug element which is connected to the female element via flexible arms. The arrangement of these elements is such that in one extreme position of the male element a liquid passage through the female element is closed by the plug element, and in another extreme position the liquid passage is open.

In practice it turns out that the known system with its rigid-on-rigid connections is often unable to ascertain a fully liquid tight closure of the liquid passage. This may lead to spoilage of liquid on the container, on the sealing units, or into the environment. This is undesirable for many reasons, for example waste, hygiene issues, and an overall bad user experience.

In addition, in practice it turns out that the known system experiences significant wear as a result of the processing of high-PH substances and as a result of temperature changes, for example when processing high-temperature substances. This reduces the lifespan of the container and sealing units, and it further increases the likelihood that the closure is not fully liquid tight.

A further drawback is that the known system is restricted to the use in sealing flexible containers, i.e. containers having a flexible wall. The known system appears to be unsuitable or less so for sealing (and opening) more rigid containers, like cans, bottles, etc. In general, when filling a container with liquid, air residing in the container is displaced and needs to be able to escape from the container in order to prevent a build-up of excess pressure. Similarly, when liquid is dispensed from the container air needs to able to enter in order to prevent the occurrence of an underpressure or negative pressure (relative to the ambient pressure). The known system fails to provide an adequate manner for air to escape from the container when the container is filled and to allow air to enter the container when its content is discharged from the container. In the case of sufficiently flexible containers, such as bags, pouches, etc. this venting issue may not arise or play an important role as such flexible containers may collapse or expand more or less freely when the container is filled or emptied, and the amount of air involved may be negligible. However, in case of a rigid container, i.e. a container having a rigid wall essentially preventing air to escape or enter the container when the container is filled at a filling station or emptied by a user, the venting of air is an issue and may influence the overall filling and dispensing and be detrimental to the performance and speed of these operations.

Furthermore, in the case of liquid formed by beverages and other consumables which are supposed to be kept and stored in the container under aseptic conditions, meaning conditions free from contamination that may be caused by harmful bacteria, viruses, or other microorganisms, additional hygiene requirements apply to the operation of filling a container and dispensing from the container. Care should be given that no liquid or only a minimum amount of liquid still remains in the sealing unit after the filling or dispensing operation.

In addition, with the consumer driven trend of sustainable consumption, where consumers may bring previously acquired packaging and containers, the demand for re-usable and in particular refillable containers, both flexible containers and rigid containers, is rising. In particular, consumers may want to refill their container only partially. As a consequence, shops allowing consumers to bring in their container for refilling need to be able ensure hygienic and environmental aspects to enable this refilling. This puts additional requirements on sealing units of such containers.

Overview

An aspect of the description relates to addressing at least one of the above problems to at least some degree.

An aspect of the description relates to providing a sealing unit and/or a sealing unit activation unit that can be used for selectively seal and open a rigid-walled container.

Another aspect of the description relates to providing a sealing unit which creates a reliable liquid- and air-tight sealing of a container.

Yet another aspect of the description relates to providing sealing units and containers which are amenable to use in a broader practice of in-shop, in-workplace, and/or in-home refilling and re-use of containers, so as to provide a technological platform to support a convenient and attractive user experience as well as to support new ways of charging per use.

According to a first aspect a sealing unit for selectively sealing and opening a container liquid opening in a liquid container for holding a liquid is provided, the sealing unit comprising: a tubular element comprising a liquid passage extending in axial direction between an inner opening and an outer opening, wherein the tubular element is configured to be fixedly positioned relative to the container liquid opening so as to provide a liquid connection between the inner opening of the tubular element and an interior of the container via the container opening; and a valve arranged inside the liquid passage of the tubular element. The valve comprises: a tubular valve portion that is configured to be axially movable inside the liquid passage relative to the tubular element between a closed position wherein the tubular valve portion seals off the liquid passage and an open position wherein the tubular valve portion leaves the liquid passage open; and a valve skirt portion extending along a circumference of the tubular valve portion, wherein the valve skirt portion is at a first side connected to or integrally formed with the tubular valve portion and at a second side connected or connectable to the tubular element, the valve skirt portion comprising a flexible skirt part configured to bend when the tubular valve portion is moved from the closed position to the open position under influence of an external axial force exerted on a force receiving part of the tubular valve portion and to urge the tubular valve portion back from the open position to the closed portion when the external a axial force is removed or reduced. The tubular element further comprises at least one air flow opening arranged to provide an air passage and wherein the at least one air flow opening is arranged to be covered by the valve skirt portion when the tubular valve portion is in the closed position and to be left open by the valve skirt portion when the tubular valve portion is in the open position.

The sealing unit therefore makes it possible to selectively prohibit a flow of air into and out of the container and a flow of liquid into and out of the container when the valve is closes, while in the situation wherein the valve is open both an air flow and a liquid flow may take place. In practice the air flow will be generally in an opposite direction of the liquid flow: when the sealing unit is connected to a filling machine and the filling machine starts filling the container (i.e. provides a liquid flow into the container), the sealing unit makes it possible to concurrently have a flow of our out of the container. Similarly, when a user wants to dispense a dosed amount of liquid from the container, the sealing unit allow the liquid to move out of container while at the same time air is entered to account for the volume of liquid being discharged from the container. Furthermore, use is made of the bending properties of the flexible valve skirt portion not only to generate a bias force automatically urging the valve back into its closed position when the external force is reduced, but also to cover and uncover the air openings in the closed and open positions so as to stop the air flow or allow the air flow to and from the container.

In embodiments of the present disclosure the at least one flow opening is arranged in a cylindrical wall of the tubular element at such a position that in an operational state and with the tubular valve portion in the open position the at least one air flow opening allows air to flow between the interior of the container and the liquid passage of the tubular element.

The sealing unit allows for an air flow from the liquid passage to the interior of the container during a dispensing operation and an air flow from the interior of the container to the liquid passage during a filling operation.

In embodiments of the present disclosure the tubular element comprises a tubular attachment element inside which a tubular interface element is arranged and wherein the air flow openings in the tubular element are comprised of one or more interface element openings in the tubular interface element of the tubular element and one or more attachment element openings in the tubular attachment element of the tubular element.

The tubular interface element may comprise a generally cylindrical wall with an outer diameter and the tubular attachment element may comprise a generally cylindrical wall with an inner diameter, wherein the outer diameter is equal or smaller than the inner diameter, wherein preferably the tubular interface element is sized to snugly fit into the tubular attachment element.

The above-mentioned valve skirt portion may be configured to be releasably connected to the interface element (215) of the tubular element (210). However, in other embodiments the valve skirt portion may be permanently connected to the interface element, for instance by welding.

The valve skirt portion may comprise at its second side a fixing portion, such as a circumferential flange, configured to hook behind a free end of the tubular interface element to connect the valve to the tubular element, wherein preferably the tubular attachment element comprises a recessed circumferential portion for accommodating at least one of the fixing portion and the free end of the tubular interface element.

In embodiments of the present disclosure at least one of the interface element openings at least partially overlaps at least one of the attachment element openings when the tubular interface is arranged in the tubular attachment element. Due to the overlap an air passage is created through the walls of the tubular element, i.e. through the neighbouring walls of the tubular attachment element and the tubular interface element.

In embodiments of the present disclosure the sealing unit comprises an additional air passage extending between an attachment element opening and an interface element opening. The additional air passage may be is formed by a wall portion of the wall of at least one of the tubular attachment element and tubular interface element having a reduced thickness relative to the thickness of the reset of the wall. For instance, the outer diameter of the tubular interface element may locally be smaller than the inner diameter of the tubular attachment element. This creates an air gap between the tubular interface element and the tubular attachment element, wherein the diameter of the tubular interface element preferably is between 0.1 and 2 mm or 0.2 and 2 mm, more preferably between 0.5 mm and 1.0 mm, smaller than the inner diameter of the tubular attachment element.

In embodiments of the present disclosure the tubular interface element comprises a circumferential recessed wall portion to provide for a circumferential air gap between the tubular interface element and the tubular attachment element.

In embodiments of the present disclosure the tubular element, preferably the tubular attachment element, comprises a closing portion radially surrounding the first opening of the tubular element configured for receiving an end of the tubular valve portion to selectively close off and open the liquid passage.

In embodiments of the present disclosure an end of the tubular valve portion comprises a circumferential radial flange shaped to sealingly rest against a closing portion of the tubular element, for instance of the attachment element thereof, when the valve is in the closed position, to seal off the liquid passage.

In embodiments of the present disclosure the tubular valve portion comprises a circumferential contact surface positioned remote from the circumferential radial flange configured to sealingly rest against the closing portion of the tubular element, for instance of the attachment element thereof, when the valve is in the open position.

In embodiments of the present disclosure the tubular valve portion comprises a skirt portion, preferably a cylindrical wall portion, wherein optionally the earlier-mentioned circumferential contact surface, is arranged at the free end of the skirt portion. The circumferential contact surface of the tubular valve portion, more specifically of the skirt portion of the tubular valve portion, makes it possible to seal the passage of liquid between a central cavity inside the tube of the tubular valve portion and a radially outer cavity between the tube and the valve skirt portion when the valve is positioned in the open position (in the closed position passage of liquid is in principle still possible but this situation would not occur when the container has already been filled). The sealing of the radially outer cavity avoids liquid being left in the radially outer cavity after a dosed quantity has been dispensed by the user and therefore also reduces the risk of contamination or other hygiene issues.

In embodiments of the present disclosure the tubular valve portion comprises one or more side openings arranged axially between the circumferential radial flange and the circumferential contact surface.

In embodiments of the present disclosure the tubular valve portion comprises a tube that is closed at one end with an end wall, wherein one or more side openings are provided in a side wall of the tube.

Inside the tube a central cavity and outside the tube, between the tube and the valve skirt portion, a radially outer cavity may be defined. One or more side openings may be arranged between the central cavity and the radially outward cavity. The valve may further be configured to selectively allow liquid flow between the inner opening and the outer opening of the tubular element via the central liquid cavity and the radially outer cavity when the valve is in the open position.

In embodiments of the present disclosure the valve skirt portion is made of material that is more flexible than the material of the remaining portions of the valve. Furthermore, the tubular element may comprises a polymer material.

In embodiments of the present disclosure the tubular element is configured to removably receive in the liquid passage a rigid operating tube of a sealing unit activation unit, the rigid operating tube configured to be axially movable inside the liquid passage of the tubular element so as to engage the force receiving part of the tubular valve portion and apply the external axial force to displace the valve to the open position.

In embodiments of the present disclosure a force receiving part of the tubular valve portion of the valve comprises a ring-shaped flat surface which is perpendicular to the axial direction of the tubular element.

In embodiments of the present disclosure the tubular element comprises connecting means configured to releasably connect the sealing unit to a fitment formed with or connected to the container so as to fixedly position the tubular element relative to the container liquid opening. The connecting means may comprise a threaded part (e.g., screw thread), a bayonet type connection, etc.

In some embodiments the tubular element or one or more portions thereof may be combined with or integrally formed with the container. For instance, the earlier-mentioned closing portion may be embodied as a part of the fitment for the container.

In embodiments of the present disclosure the tubular element is permanently connected to a fitment formed with or connected to the container so as to fixedly position the tubular element relative to the container liquid opening. This permanent connection may for instance be formed by welding. An advantage of these embodiments is that the total weight and/or the dimensions of the sealing unit may be considerably reduced.

According to a second aspect a sealing unit activation unit for selectively operating a sealing unit is provided. The sealing unit activation unit may comprise a rigid operating tube configured to be inserted into the liquid passage of the tubular element, wherein the rigid operating tube comprises an operating tube liquid passage extending in axial direction between an inner opening and an outer opening, wherein the rigid operating tube is configured to be inserted in the liquid passage of the tubular element of the sealing unit so as to apply an external axial force on a force receiving part (225) of the valve (220), thereby moving the valve from a closed position to an open position.

According to an embodiment the sealing unit activation unit further comprises an inner tube configured to be inserted in the operating tube liquid passage and defining an inner tube liquid passage between least one inner opening, preferably a radial side opening, and at least one outer opening, preferably an axial opening. The inserted inner tube may be configured to be movable in axial direction between a closed position and open position so as to open the inner tube liquid passage and to close off the inner tube liquid passage, respectively.

The sealing unit activation unit may be dispensing unit or a filling unit, for dispensing liquid from a container and filling the container with liquid, respectively. In some embodiments the sealing unit activation unit is suitable for both filling and dispensing operations, while in other embodiments the sealing unit activation unit is a dedicated unit, i.e. specifically suited for filing operations or dispensing operations, respectively.

According to another aspect an assembly comprising a liquid container for holding a liquid, the liquid container comprising a container opening, in combination with at least one of a sealing unit and a sealing unit activation unit is provided.

According to another aspect of the disclosure a method of selectively sealing and opening a container liquid opening in a liquid container provided with a sealing unit is provided. The method comprises applying an external force to the tubular valve portion arranged inside a liquid passage of a tubular element to cause the tubular valve portion to move in axial direction between a closed position wherein the tubular valve portion seals off both a liquid passage and an air passage and an open position wherein both the liquid passage and the air passage are open. The movement of the tubular valve portion further causes bending of the flexible skirt part. The method also comprises reducing the external force applied to the tubular valve portion so that the bend flexible skirt part returns to its original shape thereby urging the tubular valve portion back from the open position to the closed position.

The method may comprise when the valve is in the open position: filling the container with liquid via the liquid passage and at the same time allowing air to be discharged from the container via de air passage, or dispensing liquid from the container via the liquid passage and at the same time allowing air to enter the container via the air passage.

Applying an external force to the tubular valve portion may further comprise moving a rigid operating tube in axial direction into the liquid passage of sealing unit and applying a pushing force on the force receiving part of the tubular valve portion.

Reducing the external force applied to the tubular valve portion may comprise moving the rigid operating tube in an opposite axial direction.

BRIEF DESCRIPTION OF THE DRAWINGS

The disclosure will be explained in more detail with reference to embodiments shown in the accompanying figures.

FIG. 16A is a longitudinal section of an embodiment of the sealing unit connected to a container by means of threaded parts, while

DETAILED DESCRIPTION

Figure 1A:
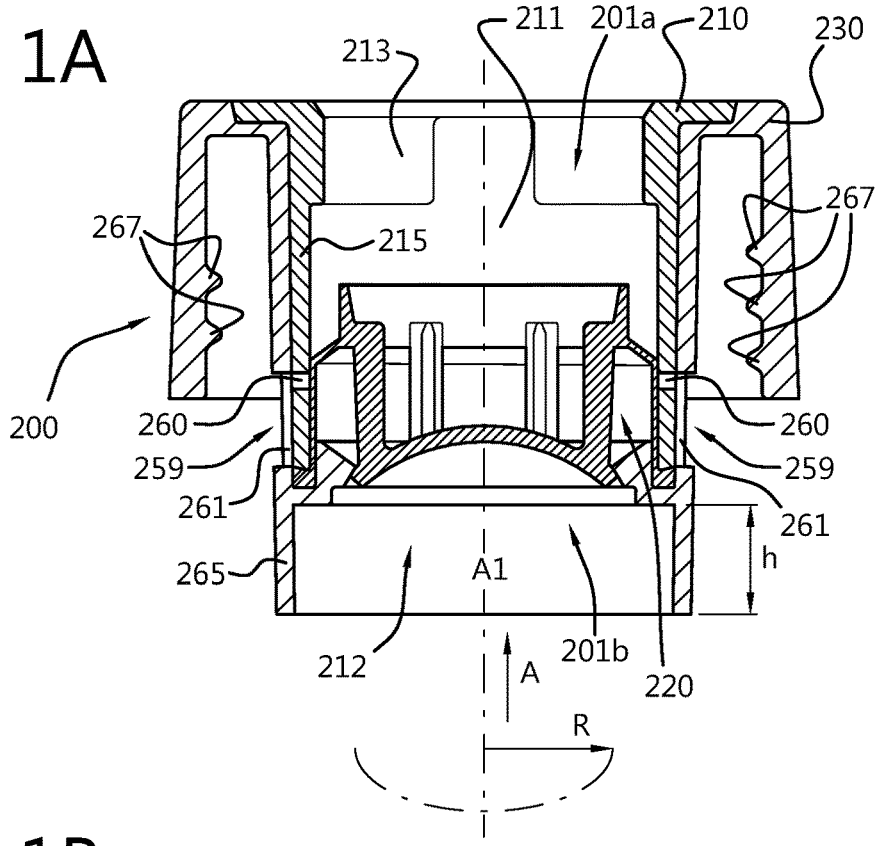
FIG. 1A and FIG. 1B show embodiments of a sealing unit 200, in a cross-sectional view.

In the following description, for the purposes of explanation, numerous specific details are set forth in order to provide a thorough understanding of the description. It will be apparent, however, that aspects of the description may be practiced without these specific details. In other instances, well-known structures and devices are not described in exhaustive detail, in order to avoid unnecessarily obscuring the present disclosure.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

In the following description when reference is made to the concept of a "container", one may consider any type of holder for holding content, for instance a bottle for liquid such as soap or oil. However, the dispenser as described herein is not restricted to application to this specific type of container 100. In fact, the dispenser as defined herein may also be applied to any other type of container 100, such as—but not limited to liquid jars, flasks, kegs, cartons, pouches, etc. A container may also be an object or system which holds liquid while it is not designed for that purpose, for example a naturally occurring source of liquid. Furthermore, the container 100 may have a non-rigid, flexible wall which may for instance change shape when the container is being filled with a liquid medium or when the liquid medium inside the container is dispensed. In other embodiments the container 100 has a rigid wall. The container has a rigid wall in the sense that the shape of the wall essentially would not change during the filling or dispensing operation. When filling the container with liquid medium the gas (air) originally present inside the container therefore is to be at least partly removed or when dispensing the liquid medium from the container, outside gas (air) should flow into the container to avoid the build-up of a low pressure (vacuum) pressure inside the container which low pressure may impede the dispensing operation.

FIGS. 1-14 show embodiments of at least a sealing unit 200 for selectively sealing an opening in a container and an activation unit 300 for activating a valve in the sealing unit 200 so as to selectively open or close this opening. Sealing units are configured to selectively seal off (an opening in) a container and open the container to allow for the transfer of liquid medium between a first location inside the container and a second location outside the container. The sealing units may be advantageously operated in a professional food service or medical environment, and in other environments such as a home kitchen or bathroom or in a workshop.

The sealing units are configured for the controlled and selective transfer of a liquid medium. This liquid medium comprises one or more liquids as such and/or substances behaving similarly enough to a liquid in flow, which substance may actually be an emulsion, a suspension, or a gel, for example. The sealing units will generally be configured to be suited for use in a generally air-filled environment, wherein the passages and cavities of the sealing units are filled with air in the absence of the liquid to be transferred.

Figure 8A:
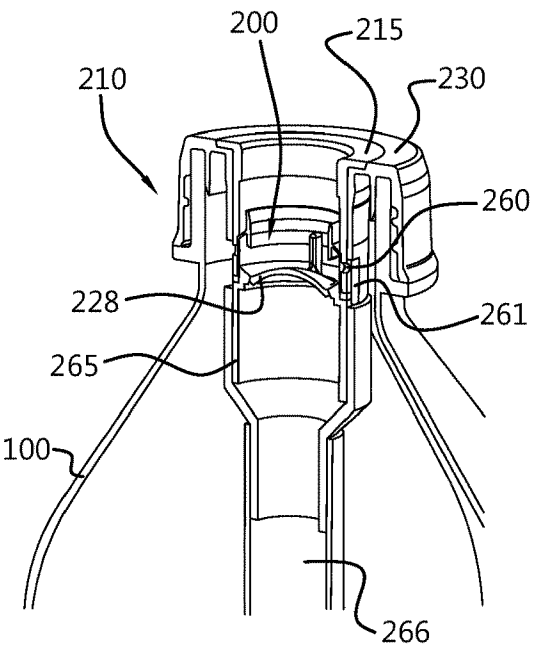
FIG. 8A, FIG. 8B, and FIG. 8C are side views in longitudinal section of a sealing unit connected to a container, respectively without a sealing unit activation unit, with a rigid operating tube of a sealing unit activation unit, and with a rigid operating tube of a dispensing unit.

In the figures, sealing units and activation units are generally shown in an orientation with their respective axial directions (A1, A2) extending toward the top of the figures, but sealing units may be operated in various other orientations relative to the direction of gravity. Activating the valve of a sealing unit to allow liquid flow is substantially independent of gravity, although inducing the actual liquid flow in a desired direction may involve gravitation. For example, when using the sealing units to pour liquid from a container as shown in FIG. 8C, a user will typically hold the connected sealing units at an angle, for example with the axes (A1, A2) extending closer to horizontal than vertical relative to the direction of gravity, so that liquid will flow out of an attached container (100) in a globally downward direction.

A sealing unit and an activation unit may advantageously be manufactured entirely out of polymer materials, for example polypropylene(s) (PE), polyurethane(s) (PU/PUR), polyphenyl ether(s) (PPE), or polyphenylene oxide (blends) (PPO). Preferably the components of the sealing units, or at least the elements of each individual sealing unit are all made of the same material or are made of a number of closely related materials which may be treated as belonging to a same class of materials for purposes of manufacturing, recycling, and/or disposal. For example, all elements of a sealing unit may be made of polypropylene. In this case, flexible elements may be made of low-density polypropylene (LDPE) or of polyphenyl ether, while rigid elements may be made of high-density polypropylene (HDPE). In another example, all elements of a sealing unit may be made of polyurethane.

The elements of a sealing/activation unit may be manufactured by any polymers manufacturing or shaping techniques. Advantageously, all components may be manufactured via injection moulding, but alternatively or additionally other techniques like extrusion, 3D-printing, or subtractive processes like machining under computer numerical control (CNC) may be used.

The elements or parts of a sealing/activation unit may be configured to be assembled by a system or device, by hand, or by a combination of the two. Substantially no glue and no chemical or temperature-based bonding process may be required at the connections of the elements of a sealing unit to attach the various elements to each other during assembly, for example no sets or only one set of connected surfaces of elements of a sealing unit may be required to be attached in such ways. Any other connections between the various elements (where required at all) may be made via fitted shapes (for example flanges or fitted rims), or via mechanical connections (for example screw thread, bayonet type closures, or protrusions and recesses to be fixedly connected after a temporary slight deformation of one of the elements).

Figure 7:
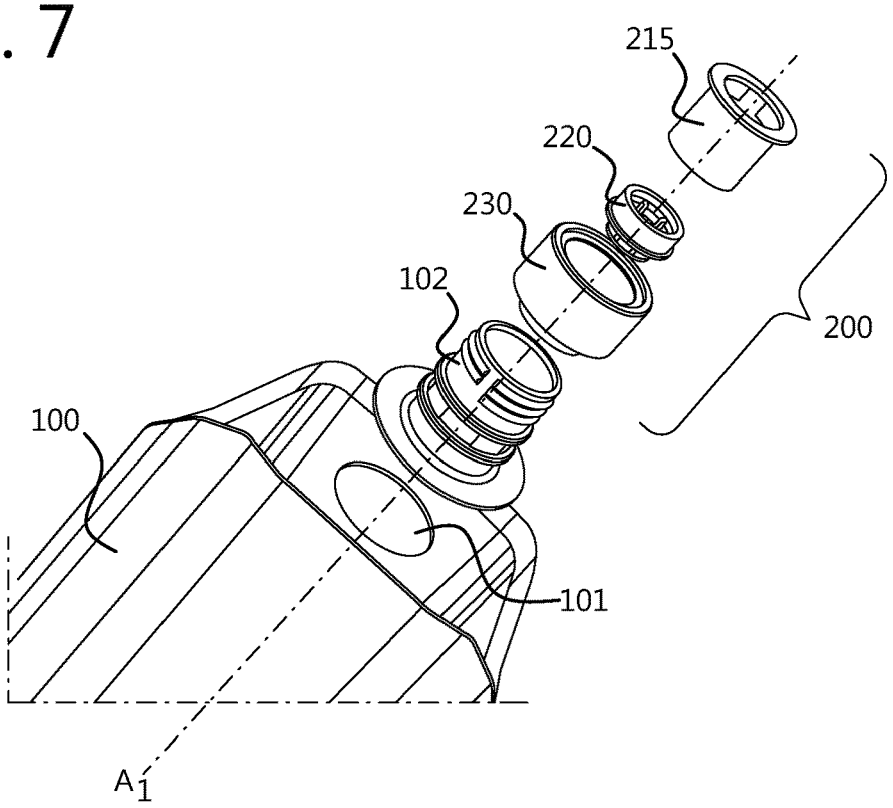
FIG. 7 is an exploded side view of a container having a fitment that can be selectively sealed by the sealing unit of FIG. 1 to FIG. 6.

FIG. 1A is a longitudinal section of a first embodiment of a sealing unit 200. De sealing unit 200 defines a first imaginary axis (A1) (denoting the axial direction), with radial (R) and circumferential (C) directions indicated in the figure as well. A sealing unit 200 may be connected to a liquid container 100 for holding a liquid, for instance a container 100 as shown in FIG. 7, for selectively sealing and opening a container liquid opening 101 thereof.

Figure 1B:
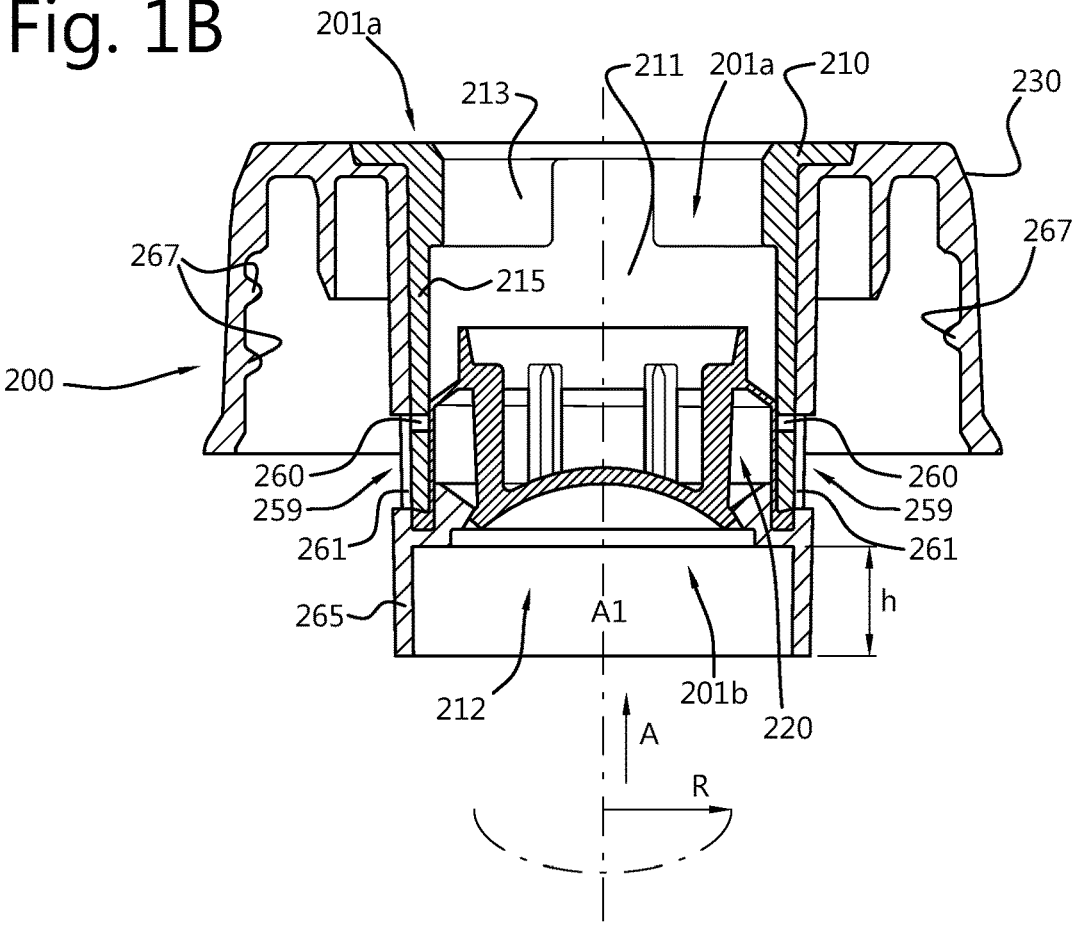

FIG. 1B is a longitudinal section showing a second embodiment of a sealing unit 200. The second embodiment fully corresponds to the first embodiment with the exception that the sealing unit according to the second embodiment is intended to be attached to a container having a wider opening 101 than the sealing unit of the first embodiment. This means that the radius of the second embodiment is larger than the radius of the first embodiment). As can be seen in this figure, all parts of the second embodiment are identical and have the same size as the parts of the first embodiment except that a cap 230 of the second embodiment is wider than the cap 230 of the first embodiment.

Referring to figures it is shown that each of the sealing units may comprise at least two elements, namely a tubular element 210 (for instance a bushing or the like) and a valve 220 (axially) movably arranged inside the tubular element 210. The tubular element 210 may be comprised of a single solid element, although in various embodiments (as shown in the figures) the tubular component 210 comprises a tubular attachment element 230 (herein also referred to as a cap or cap shell) inside which a separate tubular interface element 215 (herein also referred to as an interface ring) is arranged. The valve 220 is arranged about halfway between a first end 210*a* of the tubular element 210 and a second end 210*b* of the tubular element. As noted above, the tubular interface element 215 and the valve 220 in the embodiments of FIGS. 1A and 1B are identical, only the tubular attachment 230 is adapted to the desired width of the sealing unit (i.e. the sealing unit of FIG. 1B being adapted to seal of a relatively wide (i.e. large diameter) container liquid opening 101, while the sealing unit of FIG. 1A is suited for container liquid openings of a smaller diameter).

One or more air flow openings 259 have been provided in the tubular element 210 to allow for the above-mentioned release of air from the container during a filling operation of the container or supply of air during a dispensing operation of the container. The tubular element 210 and the valve 220 are configured in such a way that the air flow openings 259 are closed off by the valve 220 when the valve 220 for the liquid medium is in the closed position (as depicted in FIG. 8A for instance) and the air low openings 59 are open when the valve 220 is in the open position (as depicted, for instance, in FIG. 8B or FIG. 8C).

In the embodiments shown in FIGS. 1A and 1B, the air flow openings 259 in the tubular element 210 comprise one or more interface element openings 260 in the tubular interface element 215 of the tubular element 210 and one or more attachment element openings 261 in the tubular attachment element 230 of the tubular element 210. The interface element openings 260 and attachment element openings 261 are arranged so as to allow the flow of air out of or into the container when respectively filling or discharging the container, especially-however not exclusively—in case of containers having a rigid wall as will be explained later.

Figure 15:
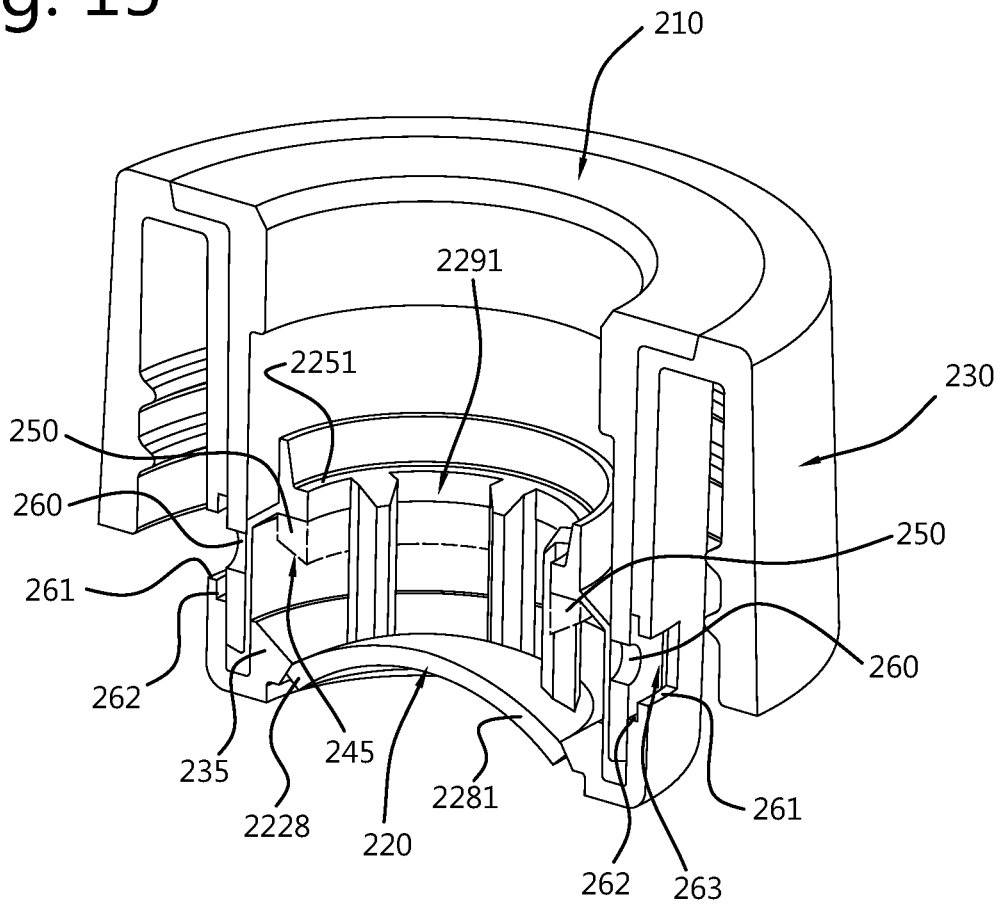
FIG. 15 is a further embodiment of a sealing unit.

In the embodiments shown in FIGS. 1A-1B, 2A-2C, and 8A-8C the one or more attachment element openings 261 are located at one or more respective circumferential positions that correspond to the circumferential positions of the interface element openings 260. In this case the interface element openings 260 and attachment element openings 261 at least partially overlap so that when the interface element opening 260 is opened when the interface element opening 260 is no longer covered by a part of the valve, an air passage is created and air may directly flow between the interior of the container 100 and the passage 211 through the tubular element 210. However, in other embodiments, for instance the embodiment shown in FIG. 15, the interface element openings 260 and attachment element openings 261 do not overlap (i.e. they are located at different circumferential and axial positions). In these embodiments a specific interface element opening 260 in other words does not overlap with any of the attachment element opening 261 so that an additional air passage 263 is needed to allow flow of air through the interface element opening 260 and an attachment element opening 261. To this end the cylindrical wall of the tubular interface element 215 may comprise one or more wall portions 262 having a reduced wall thickness (i.e. reduced relative to the wall thickness of the remaining part of the cylindrical wall of the tubular element). The reduced thickness wall portion 262 provides an air passage 263 between one or more of the interface element openings 260 and one or more of the attachment element openings 261.

Preferably the reduced thickness wall portion 262 of the tubular interface element 215 extends along the entire circumference of the wall so that the air passage 263 between the interface element openings 260 and attachment element openings 261 is guaranteed irrespective of the relative circumferential positions of the attachment element openings 261 and interface element openings 260. Furthermore, the reduced thickness wall portion 262 may extend in axial direction over a considerable height, for instance more than twice the diameter of the interface element opening 260. In other words, neither the circumferential position nor the axial position of an attachment element opening 261 needs to be correspond to respectively a circumferential position and axial position of the interface element opening 260.

In embodiments of the present disclosure, for instance the embodiments shown in FIGS. 1A-1B, 8A-8C, and 9A-9C, the tubular element 210, more specifically the tubular attachment element 230 thereof, is at its second end 201*b* formed with a generally cylindrical flange 265. The height (h, FIG. 1A) of this cylindrical flange 265 is large enough as to provide an improved separation of on the one hand the volume in which flow of liquid to and from the container takes place and on the other hand the volume in which the flow of air through the above-mentioned air flow openings 259 takes place, as will be explained later. In other embodiments of the present disclosure, for instance the embodiments shown in FIGS. 2A-2C, 10A-10C, 11A and 11B, the extension formed by the generally cylindrical flange 265 is not present and the free (bottom) end of the tubular attachment element 230 is positioned at the same height or slightly below the free (bottom) of the interface element 215 and valve 220.

Tubular Element

Figure 2A:
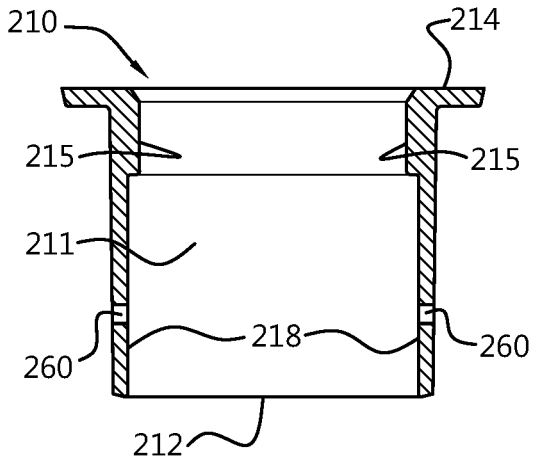
FIG. 2A, FIG. 2B, and FIG. 2C are longitudinal sections of embodiments of respectively a tubular interface element 215 (or interface ring), a valve 220, and a tubular attachment element 230 (or cap or cap shell), of a sealing unit 210.
Figure 2B:
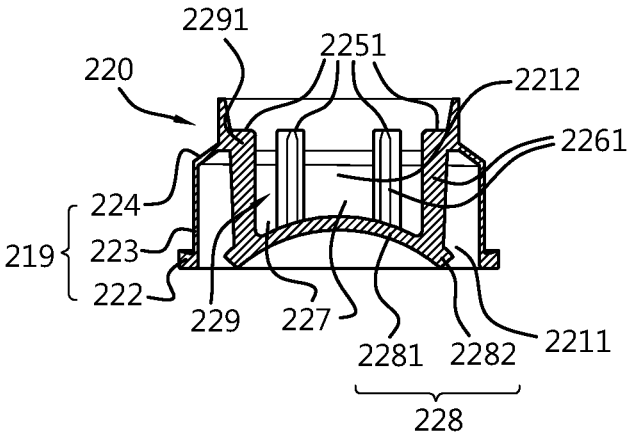
Figure 2C:
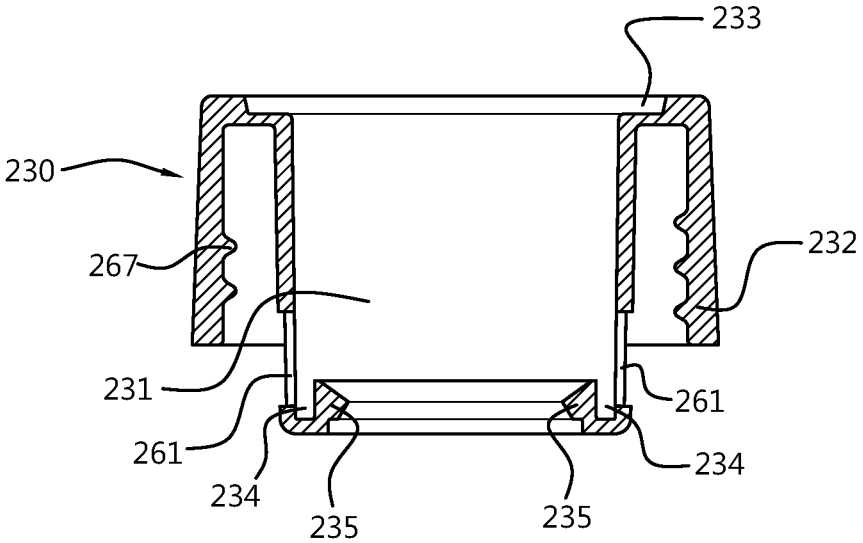
Figure 3A:
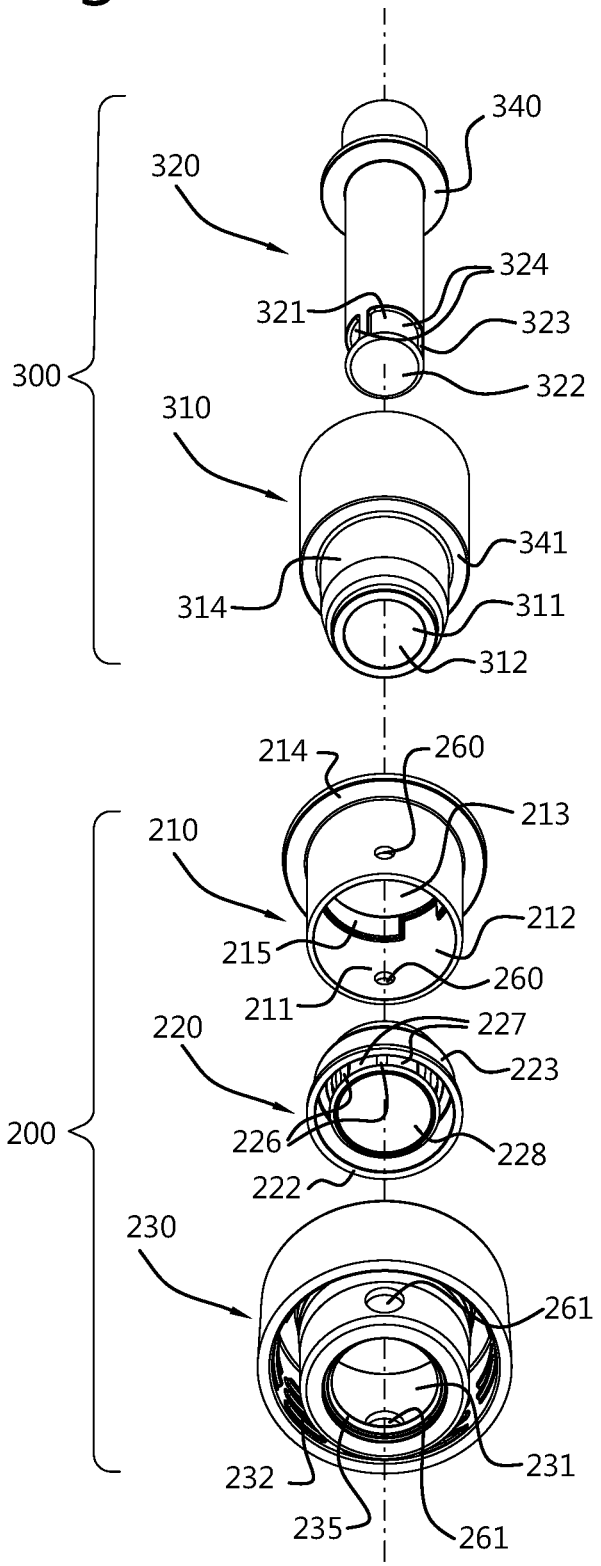
FIG. 3A and FIG. 3B are exploded views of the sealing unit and a sealing unit activation unit, seen from a lower and upper position, respectively.
Figure 3B:
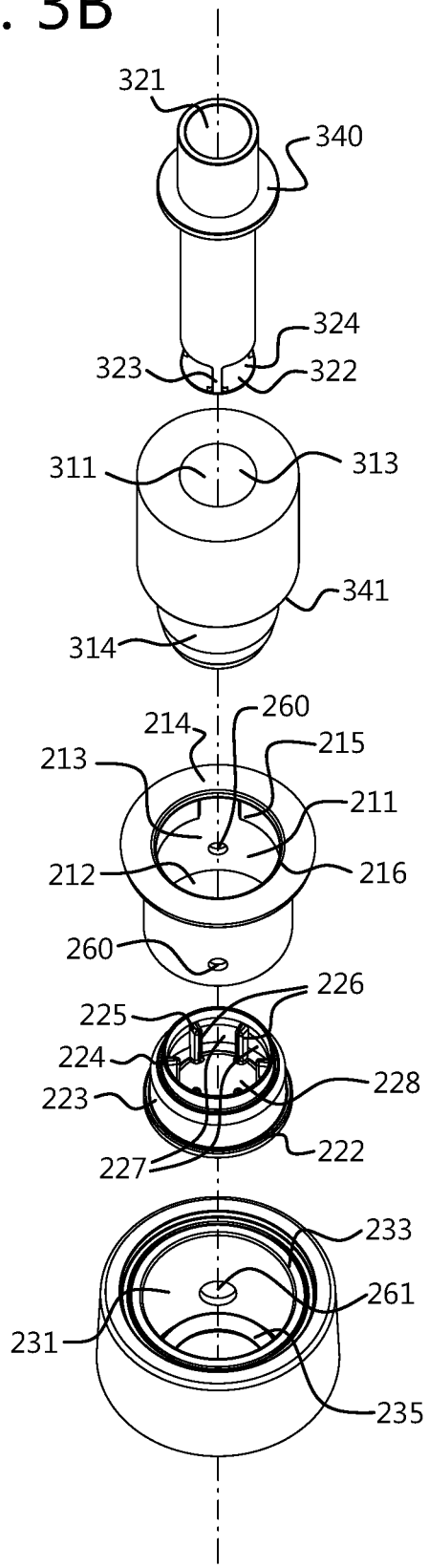

FIGS. 2A-2C respectively show longitudinal sections of an embodiment of the tubular interface element 215, the valve 220 and the tubular attachment element 230 (cap/shell). As mentioned before, the tubular interface element 215 and the tubular attachment element 230 together form the tubular element 210. FIGS. 3A and 3B are exploded views from different angles of the sealing unit 200 in combination with an embodiment of a sealing unit activation unit 300, while embodiments of the activation unit 300 are shown in more detail in FIG. 4 (first embodiment) and FIGS. 5A and 5B (second embodiment).

The tubular element 210 comprises a liquid passage 211 extending in axial direction (A1) between an inner opening 212 located at the second end 201*b* and an outer opening 213 located at the first end 201*a*, wherein the tubular element 210 is configured to be fixedly positioned relative to the container liquid opening 101 so as to provide a liquid connection between the inner opening of the tubular element 210 and the container opening 101.

Figure 16A:
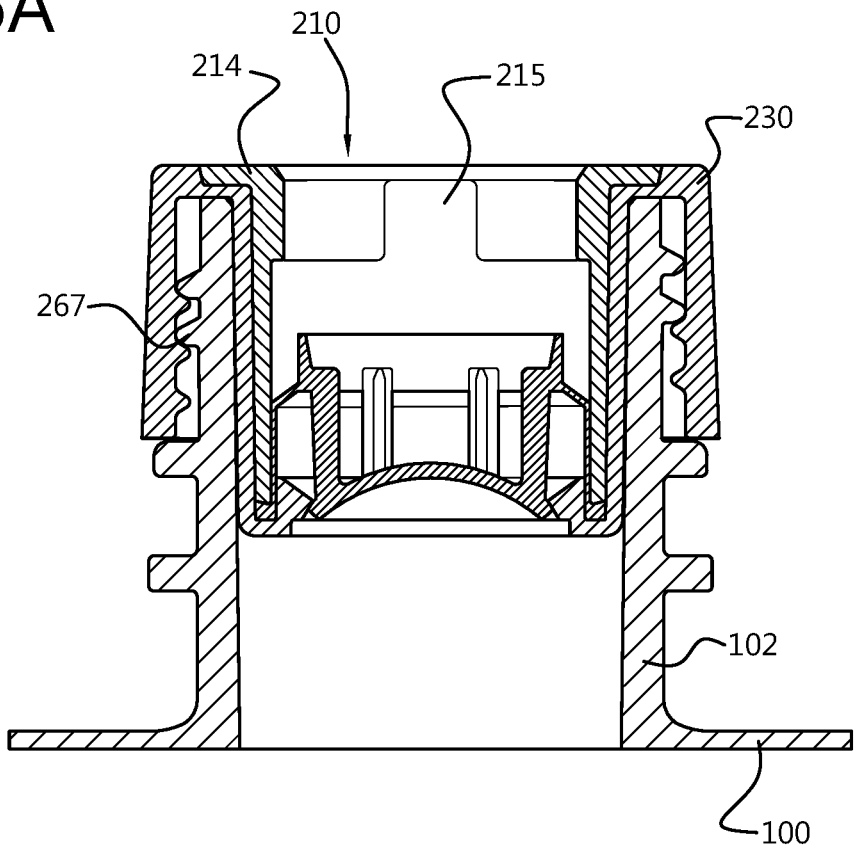
Figure 16B:
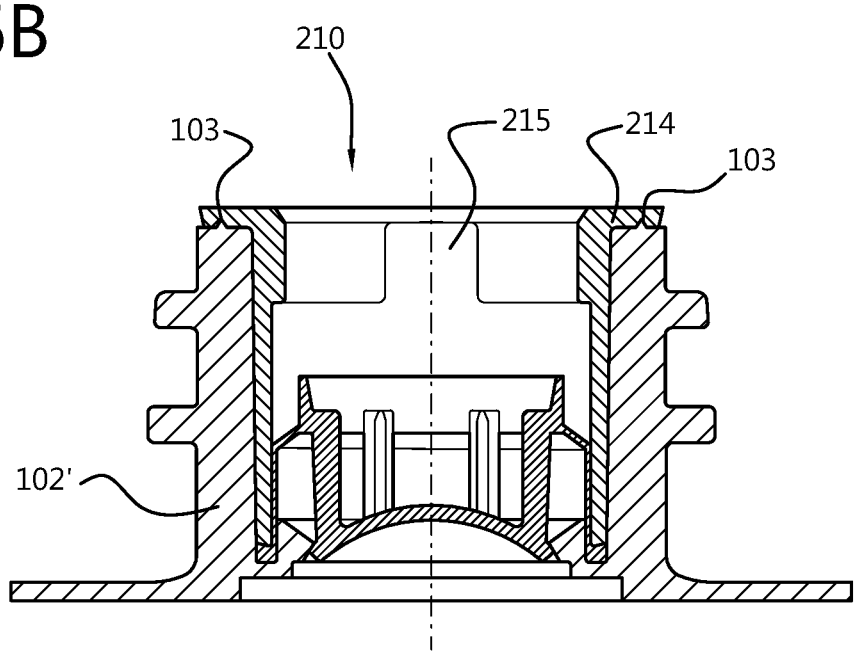
FIG. 16B is a similar section of another embodiment of a sealing unit, wherein threaded parts have been dispensed with and wherein the sealing unit has been permanently attached to the container.

In this context, fixedly positioning may involve attaching the tubular attachment element 230 of the tubular element 210 (for instance using the threaded part 267 shown in FIGS. 1A and 1B) to a fitment 102 of the container 100 (cf. FIG. 16A) or by permanently attaching the tubular element 210 to the fitment 1021 of the container, for instance by permanently welding the tubular interface element or ring 215 to the fitment of the container (cf. FIG. 16B, wherein the weld 103 is shown schematically at the upper end of the fitment/attachment element) so that a threaded part 267 can be dispensed with and the total weight of the tubular element 210 may be reduced, for instance by more than 25%. FIG. 16B also shows that the fitment 1021 is combined or integrated with the tubular attachment element 230 to form one single part. The interface element 215 is attached via one or more welds 103 to the fitment 102 of the container 100.

The depicted interface element 215 of the tubular element 210 comprises a radially outwardly protruding circumferential portion 214 near its axially outward end 201*a*. Portion 214 can be arranged in a similarly shaped recess 233 in the upper part of the attachment element 230 (see, for instance, FIG. 2C). In this manner the tubular interface element 215 can be closely fitted into the tubular attachment element 230. Note that in other embodiments the tubular attachment element 230 is combined with a fitment 1021 for a container 100 and in these embodiments the recess 233 can be dispensed with so that the portion 214 is directly supported on the fitment 1021 (which fitment in this case is considered to comprise a tubular attachment element 230). In still other embodiments the tubular interface element 215 and the tubular attachment element 230 are integrated to form one single part. In these embodiments the radially outwardly protruding circumferential portion can be dispensed with altogether.

FIG. 2C shows in more detail the embodiment of FIGS. 1A and 1B of a cap shell or tubular attachment element 230. The tubular attachment element 230, when present as element of the sealing unit 200, defines a second liquid passage 231 which contains the tubular element 210, and comprises a threaded part 267 for detachably connecting the tubular attachment element 230 to the liquid container 267 and the earlier-mentioned circumferential recess 233 for fixedly connecting the tubular attachment element 230 to the tubular interface element 215.

The tubular attachment element 230 further comprises a recessed circumferential portion 234 radially surrounding the opening located at the second end 201*b* for receiving a fixing portion 222 of the valve 220 (cf. FIG. 2B) and optionally (as in FIGS. 1A and 1B) a free end of the tubular interface element 215 of the tubular element 210. This recessed circumferential portion 234 serves to fix the tubular interface element 215, the valve 220, and/or the tubular attachment element 230 relative to each other. Other types of portions for fixing the elements of the sealing unit 200 relative to each other may alternatively or additionally be provided on the tubular attachment element 230.

The tubular attachment element 230 further comprises, at the free end of the recessed circumferential portion 234, a valve seat in the of form of a radially inwardly extending circumferential closing portion 235. The circumferential closing portion 235 surrounds the second passage 231 (and the first (liquid) passage 211) of the tubular element 210. The circumferential closing portion 235 serves as a valve seat for the valve 220. More specifically, the circumferential closing portion 235 may receive a radiale circumferential flange 2282 (see FIG. 2B) of the valve, in order to create a liquid-tight connection between the valve 220 and the tubular element 210 when the flange 2282 of the valve 220 is pressed onto the circumferential closing portion 235 of the tubular element 210 (the pressing of the valve 220 onto the tubular element 210 is caused by the biasing force of a valve skirt portion 219 of the valve, in case there is no (sufficiently high) opposing external force exerted by an activation unit 300 that has been inserted into the sealing unit 200). This makes it possible to selectively close off the liquid flow passage defined inside the tubular element 210 from the flow passage defined inside the container (see, for instance, FIGS. 1A and 1B).

It is noted here that in the embodiment of FIGS. 1A, 1B, 2A-2C there is always an open connection (via radial side openings 227) between a central cavity 2212 of the flow passage in the tubular element 210 (i.e. the central portion of the flow passage inside the tubular element and inside the tube (2291) of the tubular valve portion 229) and a radially outer cavity 2211 (i.e. a portion sideways of the central cavity 2212, as is shown, for instance, in FIG. 2B. the radially outer cavity 2211 is in fact the interspace between the outer surface of the wall of the tube (2291) (including elements 2261) and the inner surface of the valve skirt portion 219), irrespective of whether the valve 200 is closed or open. However, in other embodiments, for instance the embodiment of FIG. 13, FIGS. 9A-9C and, optionally, in FIG. 15, the valve 200 is provided with an additional skirt portion 250. The bottom side of the additional skirt portion 250 forms a circumferential contact surface 245 that may be pressed onto the circumferential closing portion 235 of the tubular element 210 as well when the tubular element 210 is moved axially downward, i.e. when the valve is opened. In the latter embodiments the radially outer cavity 2211 may therefore be kept free from liquid when the valve is in the open position. This may avoid contamination of the sealing unit as a result of liquid remaining in the radially outer cavity 2211.

Valve

FIGS. 2B, 3A and 3B show an embodiment of a valve 220. The valve 220 may comprise or consist entirely of a flexible sheet, wherein preferably the valve 220 comprises a polymer material. The valve 220 may comprise a tubular valve portion 229 that is arranged inside the (second) liquid passage 231 to be moved in axial directions between a closed position and an open position. The tubular valve portion 229 comprises a pressure or force receiving part 225, for instance comprised of a ring-shaped flat surface 2251) (FIG. 2B) perpendicular to the first imaginary axis (A1) and/or a guiding rim 2252 arranged around its radial outside, which extends substantially toward the axial outside. On top of the force receiving part 225 the outer end of an activation unit 300 (various embodiments of activation units 300 including dispensing units 400 are shown in one or more of FIGS. 4, 5A, 5B, 8B, 8C, 9B-9C, 10A-10C, 11A-11B, 12).

The tubular valve portion 229 typically is formed by a tube-shaped element (herein also referred to as tube 2291) that is closed at one end with an end wall, for instance a dome-shaped end wall. The wall (e.g., a cylindrical wall) of the end portion of the tube-shaped element next to the end wall 2281 however has one or more radial openings 227 (herein also referred to as side openings) allowing liquid to pass the valve, i.e. when the valve is in the open position. The end wall 2281 is connected to the tubular valve portion 229 via a number of connecting parts 2261 forming part of the earlier-mentioned wall of the tube-shaped element or tube 2291. The side openings enable liquid flow between the inside of the container and the tubular element 210.

At the position of the end wall the tubular valve portion 229 of the valve further comprises a circumferential radial flange 2228 that may me caused to rest against the radially inwardly extending circumferential closing portion 235 of the tubular element 210, for instance the attachment element 230 thereof, when the vale is in the closed position. More specially, the circumferential flange 2282 may be moved to come to contact the inward side (bottom side in the figures) of the closing portion 235, thereby completely sealing of the liquid passage inside the tubular element 210. In the closed position the flange 2282 closes off the central liquid cavity 2212 (and in the embodiment of FIG. 2B also the radially outer liquid cavity 2211) to liquid.

In case the second closing portion 228 of the valve 220 comprises a circumferential radial flange 2282, the circumferential radial flange 2282 preferably extends the domed shape of the central portion 2281, but other shapes are also possible for an element which serves to selectively allow liquid flow from the first inner opening 212 to the liquid cavities 2211, 2212, as long as a liquid-tight connection may be achieved to a portion of another element of the sealing unit 200.

The tubular valve portion 229 is connected to the tubular element 210 by a valve skirt portion 219. The valve skirt portion 219 of the valve 220 comprises a fixing portion 222, such as a circumferential flange, configured to hook behind a free end of the tubular interface element 215 and to be arranged in the recessed circumferential portion 234 of the attachment element 230.

The fixing portion 222 of the valve 220 is part of a valve skirt portion 219 configured to attach the tubular valve portion 229 to the tubular element 210. The valve skirt portion 219 in turn comprises a flexible skirt part 224 and a further skirt portion 223. The valve skirt portion 219 defines radially outer cavity 2211. In some embodiments, for instance the embodiment shown in FIG. 2B, this outer cavity 2211 may contain liquid from the liquid container 100, for instance liquid that remains in the cavity after a dispensing action. In other embodiments, for instance the embodiment of FIG. 13, this outer cavity 2211 always remains sealed off from the liquid in the container by means of the earlier-mentioned additional skirt portion 250.

The flexible skirt part 224 is configured to bend under axially inward external pressure (exerted by an external activation unit) and to reassume essential the initial shape, herein also referred to as the resting shape, in the absence of the external pressure. In other words, when the externa activation unit 300 is removed and the external force on the valve is removed, as well, the valve skirt portion 219 moves back to its resting shape, thereby also taking with it the tubular valve portion 220 connected thereto so that the tubular valve portion 229 automatically moves from the open position back to the closed position.

The valve 220 is arranged inside the first liquid passage 211. The tubular valve portion 229 is axially movable inside the liquid passage 211 between a closed position (see for instance FIGS. 1A, 1B, 8A, 9A, 10A, 11A, and (A), (B), (F), and (G) of FIG. 12) wherein the tubular valve portion 229 closes the liquid passage 211 and an open position (see FIG. 1B, 8C, 9B, 9C, 10B, 10C, 11B, and (C), (D), and (E) of FIG. 12) wherein the tubular valve portion 229 leaves the liquid passage 211 open thereby allowing liquid to be moved out of or into the container 100. The tubular valve portion 229 is integrally formed with or connected to a valve skirt portion 219. More specifically, the valve skirt portion 219 is connected at one circumferential edge to the tubular valve portion 229 and at an opposite, circumferential edge to the tubular element 10. Furthermore, the valve skirt portion 219 comprises a flexible portion 224 configured to bend when the tubular valve portion 229 is caused to move from the closed position to the open position under influence of an external axial force exerted on a force receiving part 225 of the tubular valve portion 229 (by the activation unit 300) and to urge the tubular valve portion 229 back from the open position to the closed portion when the external axial force is reduced or removed.

In order to provide an external pressure or force, the tubular element 210 is configured to removably receive in the liquid passage 211 a rigid operating tube 310 of an activation unit 300 or a similar rigid operating tube 410 of a dispensing unit 400, the rigid operating tube 310, 410 configured to be axially movable inside the liquid passage 211 of the tubular element 210 so as to engage the force receiving part 225 of the tubular valve portion and apply the above-mentioned external axial force to open the valve 220.

Activation Unit

FIGS. 4, 5A, 5B, 8B, 9B, 10A-10C, 11A-11B, 12 show embodiments of a sealing unit activation unit 300 configured—when attached to a sealing unit 200—to cause the sealing unit 200 to open or close its valve so as to selectively induce or at least allow liquid flow through a liquid passage of the sealing unit. The axial direction is indicated as a second imaginary axis (A2), with radial (R) and circumferential (C) directions indicated in the figure as well.

A sealing unit activation unit 300 may be used to selectively allow flow a liquid into a container to which the sealing unit is attached (filling operation). The sealing unit activation unit 300 may also be used to selectively allow flow of liquid out of the container (dispensing operation). In embodiments of the present disclosure the same sealing unit activation unit 300 may be used for filling a container and dispensing the container. In other embodiments a (first) sealing unit activation unit 300 (also referred to as a filling unit) designed for filling the container and a separate (second) sealing unit activation unit 300 (herein also referred to as a dispensing unit 400) designed for dispensing liquid from the container are used. In the latter embodiments the first sealing unit activation unit 300 may be configured to be releasably attached to a filling machine, for instance located in a shop or supermarket, while the second sealing unit activation unit 300 is configured to allow a user to easily dispense dosed amounts of the liquid from the container, for instance at home.

Figure 5B:
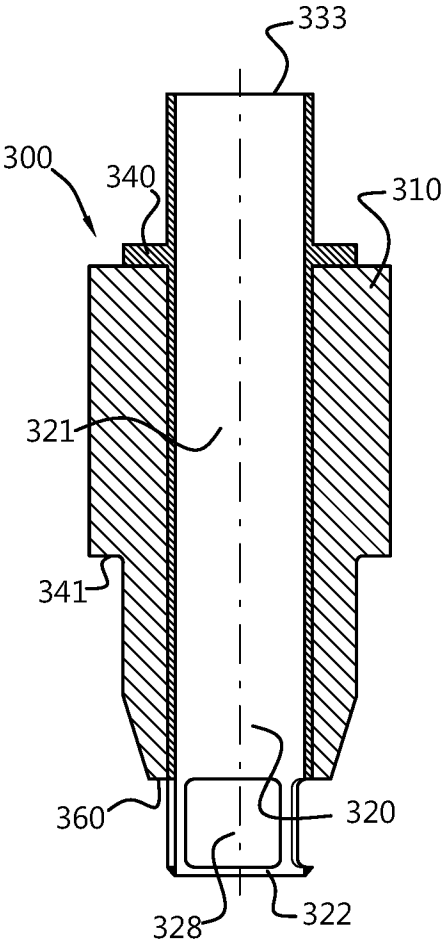
FIG. 5A and FIG. 5B FIGS. 5A 5B are longitudinal sections of various parts forming a second embodiment of a sealing unit actuator.
Figure 5A:
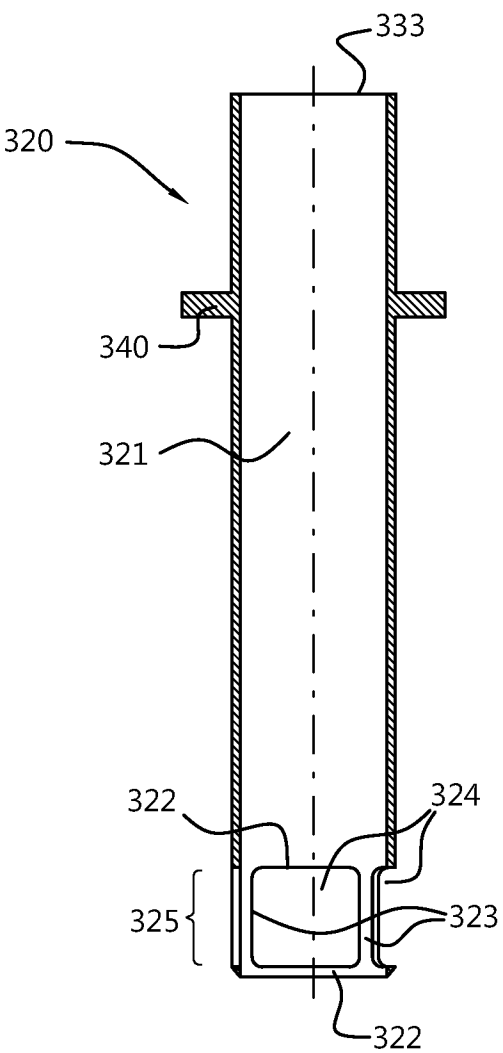

In embodiments of the present disclosure, the sealing unit activation unit 300 comprises at least a rigid operating tube 310, 410 (in the embodiments of FIG. 4 and FIG. 8C, respectively) or at least a rigid operating tube 310 and a further, inner tube 320 which is rigid as well (in the embodiment of FIGS. 5A and 5B). The inner tube 320 is movable in axial direction between a retracted position (shown in, for instance, (A), (B), (C), (E), (F), and (G) in FIG. 12) and an extended position (shown in FIG. 5B, and (D) in FIG. 12).

Figure 4:
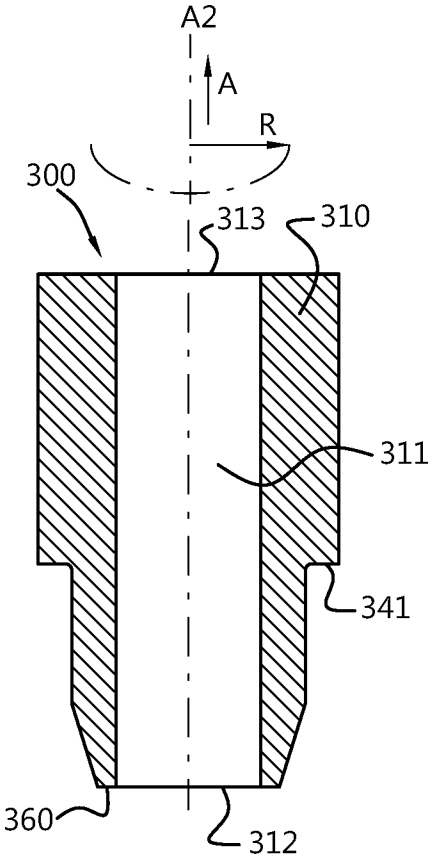
FIG. 4 is a longitudinal section of a first embodiment of a sealing unit actuator.
Figure 6:
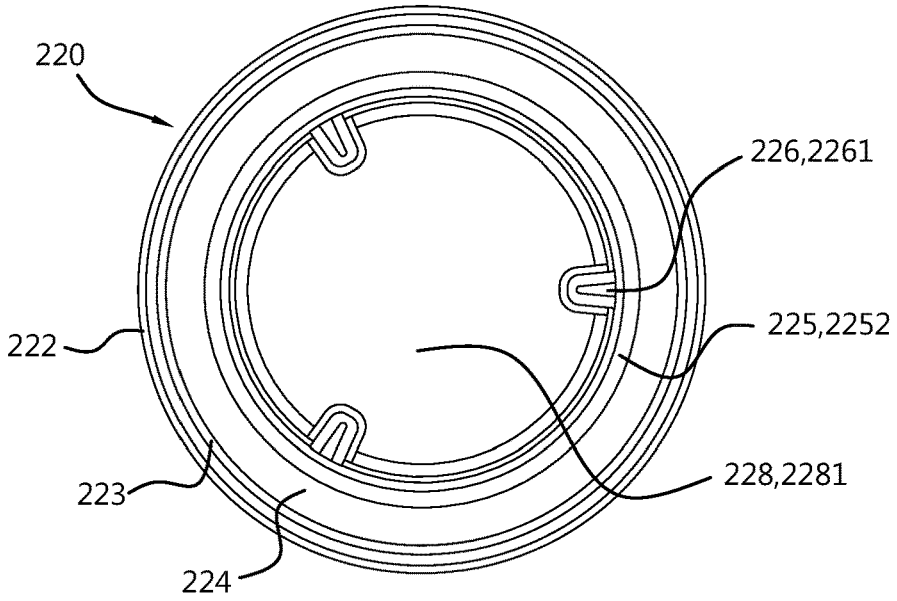
FIG. 6 is a cross-section of an embodiment of a valve 220.

Referring to the first embodiment as shown in FIG. 4, the rigid operating tube 301 comprises an operating tube liquid passage 311 extending in axial direction (A1) between an inner opening 312 and an outer opening 313, wherein the rigid operating tube 301 is configured to be inserted in the liquid passage 211 of tubular element 210 of the sealing unit 200. The tube 301 is inserted far enough in the sealing unit 200 that the annular edge 360 of the tube comes into contact with the ring-shaped flat surface 2251 of the force receiving part 225 of the valve 200. When the tube 301 is inserted further into the sealing unit, the tube 301 exerts an external axial force on the force receiving part 225, thereby moving the valve from a closed position to an open position. The wall of the rigid operating tube 301 comprises a widened section serving as an abutment portion 341. The abutment portion 341 serves to limit the distance over which the tubular valve portion 229 thereby reducing the risk of damaging the valve.

Referring to the second embodiment as shown in FIGS. 5A and 5B, the inner tube 320 is arranged inside the tune 310 so as to be movable in axial direction. The inner tube 320 is closed at one end by end wall 322 but is provided with a number of radial openings 328 close to position of the end wall 322. The inner surface of the second liquid passage 311 of the rigid operating tube 301 is configured to snugly fit the outer surface of the 320. This prevents liquid to flow out of the radial openings when the inner tube 320 is in its retracted position. However, when the inner tube is moved from the retracted to the extended position, liquid may freely flow through the radial openings 328.

A sealing unit 200 and a sealing unit activation unit 300 (including a dispensing unit 400) may be connected to each other, to form an interoperating system. Connection may be accomplished by simply inserting a portion of the activation unit 300 into the sealing unit 200. When connected to a liquid container 100, an assembly formed by the system of the sealing unit 200 and the sealing unit activation unit 300 and the container 100 may be used by a user or by a device to selectively allow liquid to flow through an opening 101 of the container 100. Examples of this are pouring liquid from the container 100 or, in the case wherein the assembly comprises a sealing unit activation unit 300 as well, filling or refilling the container 100.

Operation

Figure 9A:
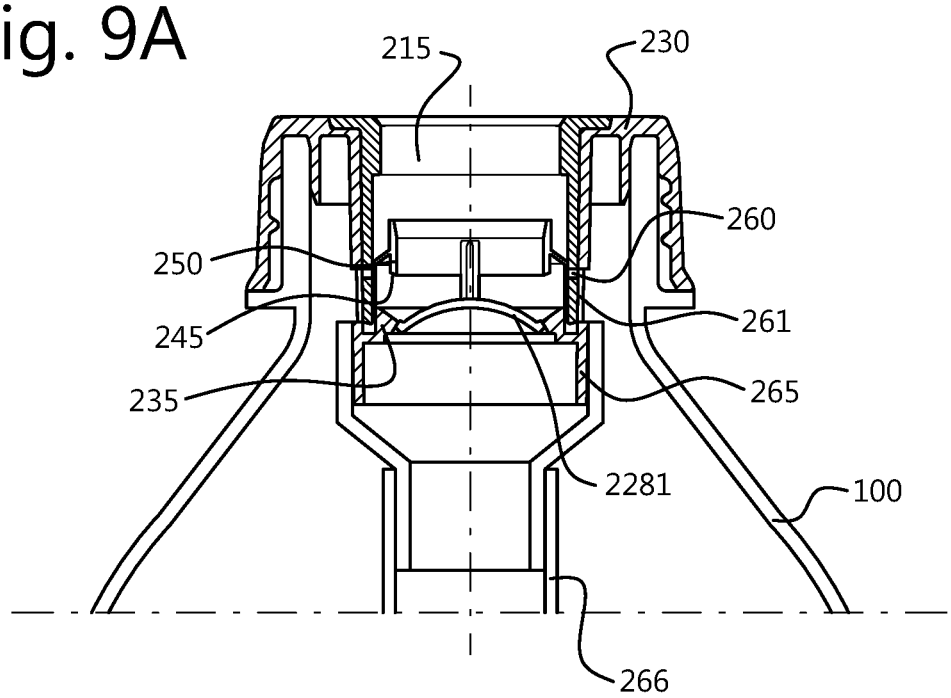
FIG. 9A, FIG. 9B, and FIG. 9C are longitudinal sections showing a container provided with a sealing unit, wherein FIG. 9A relates to a closed, sealed-off state, FIG. 9B relates to a state wherein a sealing unit activation unit has activated the valve of the sealing unit to allow filling of the container with a medium, and FIG. 9C relates to a state wherein a sealing unit activation unit has activated the valve of the sealing unit to allow dispensing of the medium from the container.

FIGS. 8A and 9A show respectively a partially cut-away perspective view and a cross-sectional view of an embodiment of a sealing unit 200 attached to a container 100, with the valve 200 in its closed position. The sealing unit 200 generally corresponds to the sealing unit of FIGS. 1A-1B, 2A-2C. The cylindrical flange 265 of the sealing unit 200 has been provided with a flow tube 266, extending to a position close to the bottom of the container.

In the closed position shown in FIGS. 8A and 9A, the flexible portion 224 of the valve skirt portion 219 urges the valve 200 into its seat, i.e. against the circumferential closing portion 235. Liquid inside the passage 211 of the tubular element 210 and liquid inside the container 100 cannot bass the valve. In the shown embodiment liquid may flow from the passage 211 to the radially outer liquid cavity 2211 and back. In other embodiments, for instance the embodiment of FIG. 13 wherein an additional skirt 250 is provided, this additional skirt avoids in this position the situation that liquid from the passage 211 enters the radially outward liquid cavity 2211. The radially outward liquid cavity 2211 remains empty (i.e. remains filled with air) so that the risk of contamination of the liquid flow by remnants of liquid in the radially outward liquid cavity 2211 once the valve is opened, is reduced.

Similarly, in the closed position of FIGS. 8A and 9A, the valve skirt portion 219 is arranged to cover the interface element openings 260 in the tubular interface element 215, thereby effectively blocking any flow of air to and from the container through the air flow openings 259.

FIGS. 8B, 8C, 9B and 9C represent the sealing unit in an open position. More specifically, FIGS. 8B and 9B respectively show a partially cut-away perspective view and a cross-sectional view of the embodiment of the sealing unit 200 in an open position during a filling stage wherein the container is filled with a liquid, while FIGS. 8C and 9C respectively show a partially cut-away perspective view and a cross-sectional view of the embodiment of the sealing unit 200 in an open position during a dispensing stage wherein the container is caused to dispense its content.

Figure 8B:
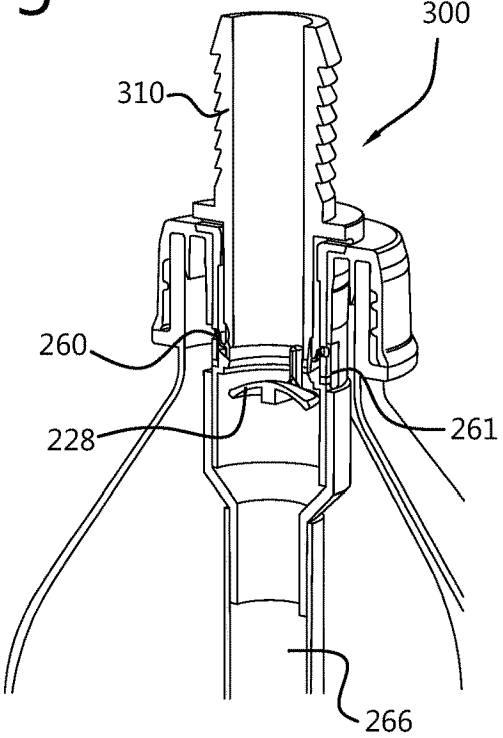
Figure 8C:
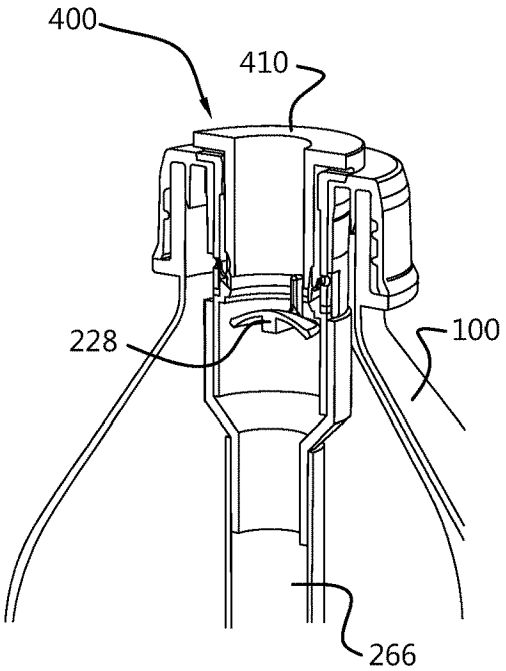
Figure 9B:
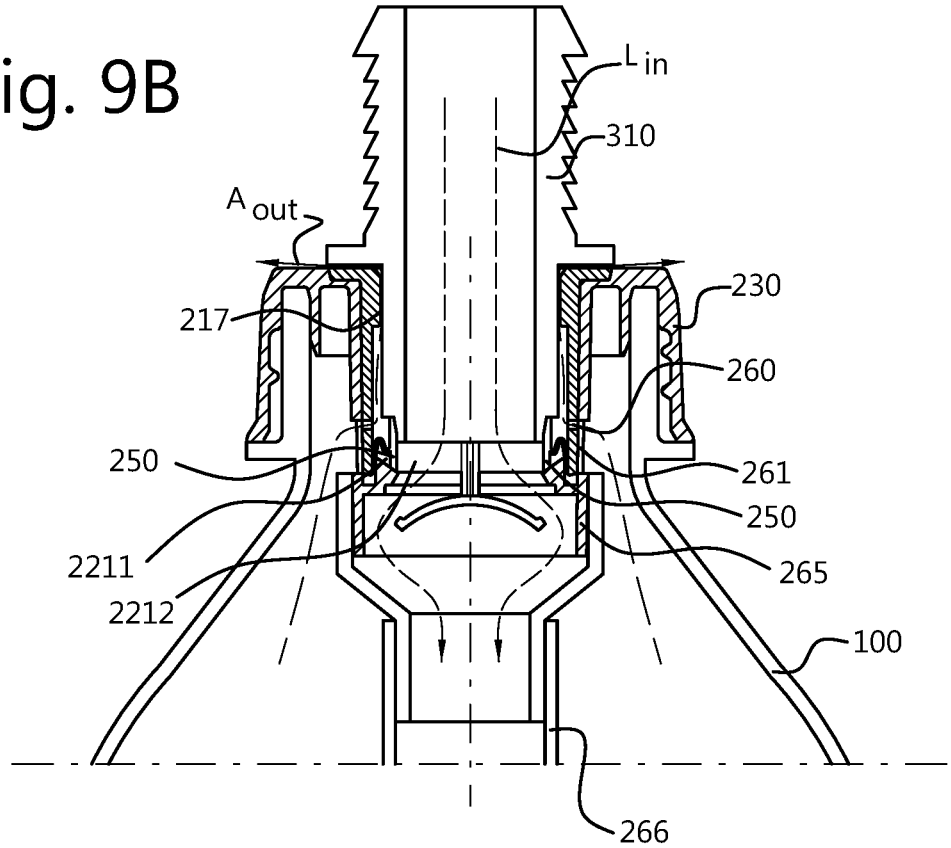
Figure 9C:
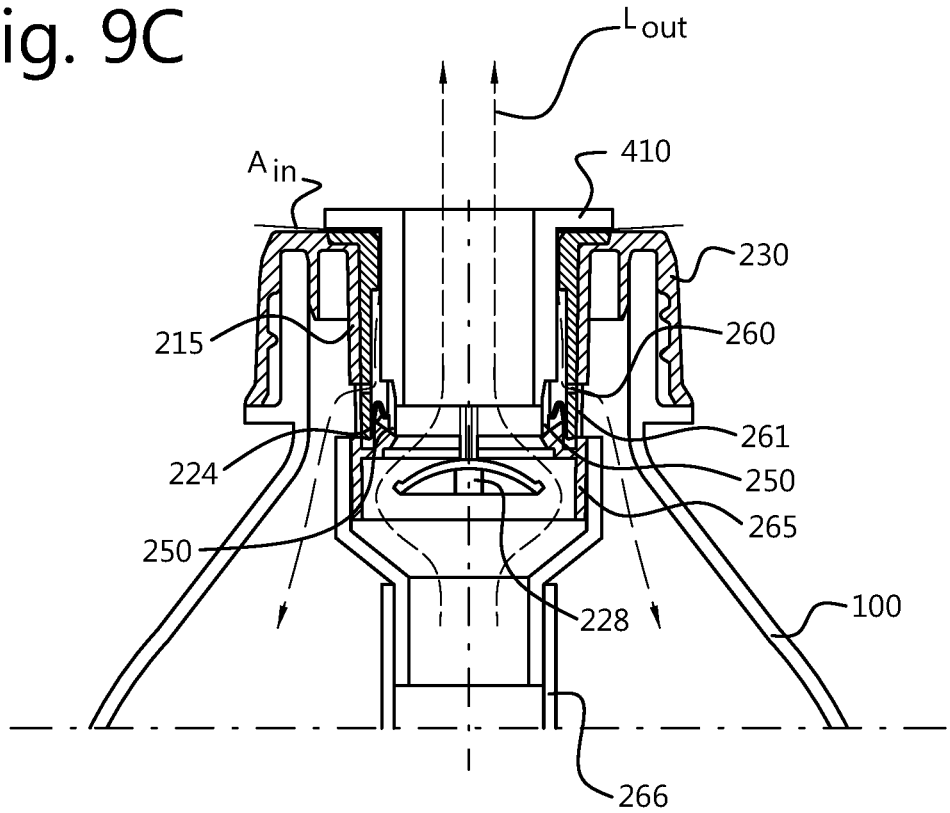

In the filling stage of FIGS. 8B and 9B the valve 200 is forced to move in axial direction from the closed position to the open position by means of the earlier-mentioned rigid operating tube 310, while in the dispensing stage of FIGS. 8C and 9C the valve 200 is forced to move in the same, axial direction by a rigid operating tube 410 of a dispensing unit 400 similar to the rigid operating tube 310.

In the open position the valve has been released from its seat formed by the circumferential closing portion 235 so that radial side openings 227 of the valve 220 become positioned at a location beneath the circumferential closing portion 235. This allows liquid to flow between the interior of the container and the passage 211 inside the tubular element. In the filling stage this means that liquid from the filling machine (not shown) is allowed to flow through the passage 211, and then through the radial side opening 227 into the interior of the container 100, which is indicated in FIG. 9B with arrows $L_{in}$. In the dispensing stage this means that liquid from the container 100 is allowed to flow from the interior, through the radial side openings 227 into the passage 211 of the sealing unit, which is indicated in FIG. 9C with arrows $L_{out}$.

Furthermore, in the open position, the valve skirt portion 219 has been forced to bend in such a manner that the interface element openings 260 are exposed, i.e. no longer coved by the valve skirt portion 219. In this position the interface element openings 260 are no longer blocked and air can move freely between the interior of the container 100 and the first liquid passage 211 of the interface element 215 via the air flow openings 259. More specifically, in the filling stage shown in FIGS. 8B and 9B, air is allowed to flow from the interior of the container, via de attachment element opening 261, via the air passage 263 between the interface element openings 260 and attachment element openings 261 (if present), and then via the interface element opening 260 into the liquid passage 211. More specifically, air may flow in the annular interspace 217 between the outer surface of the rigid operating tube 310 and the inner surface 218 (cf. FIG. 2A) of the tubular interface element 215. In the filling stage depicted in FIGS. 8B and 9B the air is allowed to escape from the container 100 (see the path of the air flow indicated in FIG. 9B with arrows $A_{out}$). In the dispensing stage depicted in FIGS. 8C and 9C the air is allowed to enter the container 100 (see the path of the air flow indicated in FIG. 9C with arrows $A_{in}$).

Figure 10A:
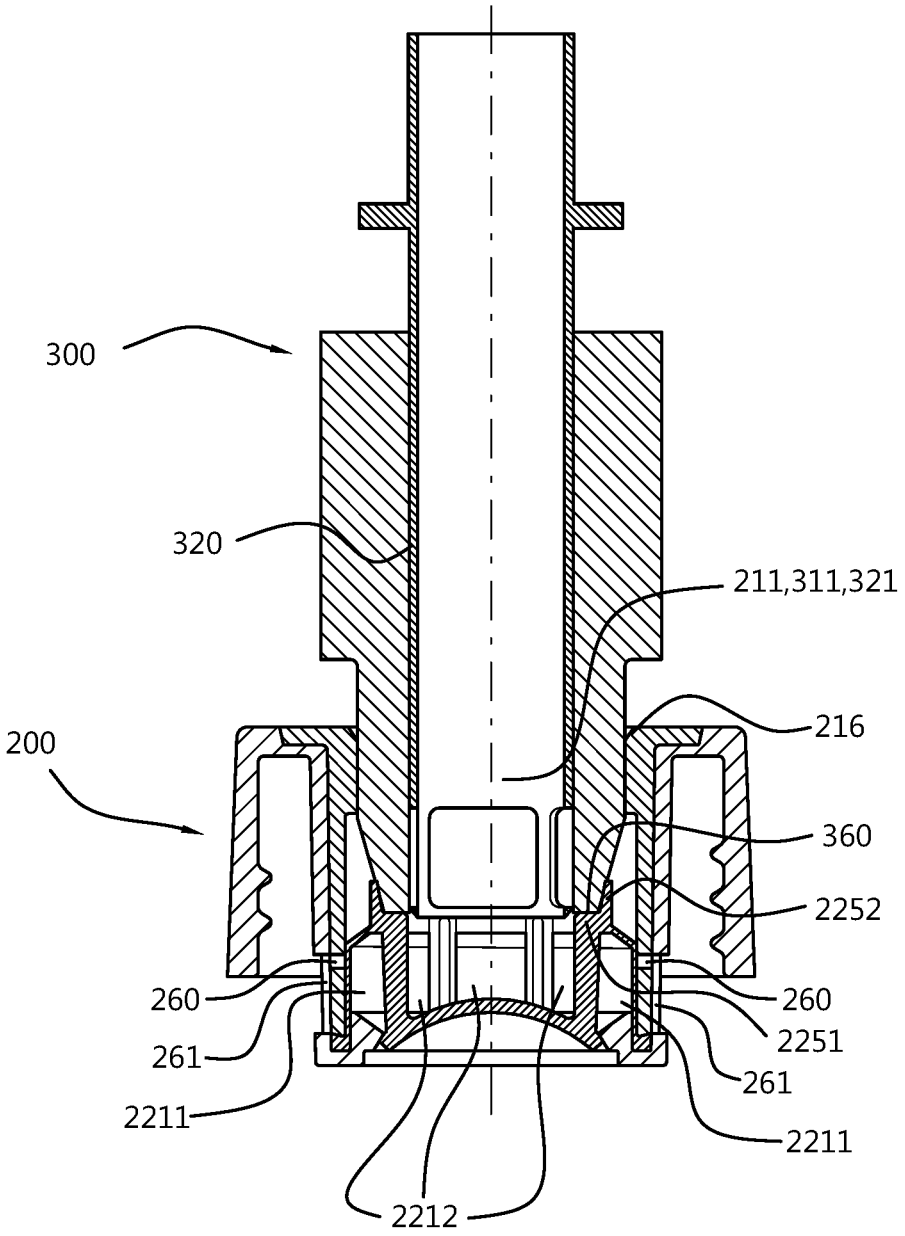
FIG. 10A, FIG. 10B, and FIG. 10C are a more detailed longitudinal sections of a sealing unit wherein a rigid operating tube according to the second embodiment of the sealing unit activation unit has been inserted, in consecutive states of operation.
Figure 10C:
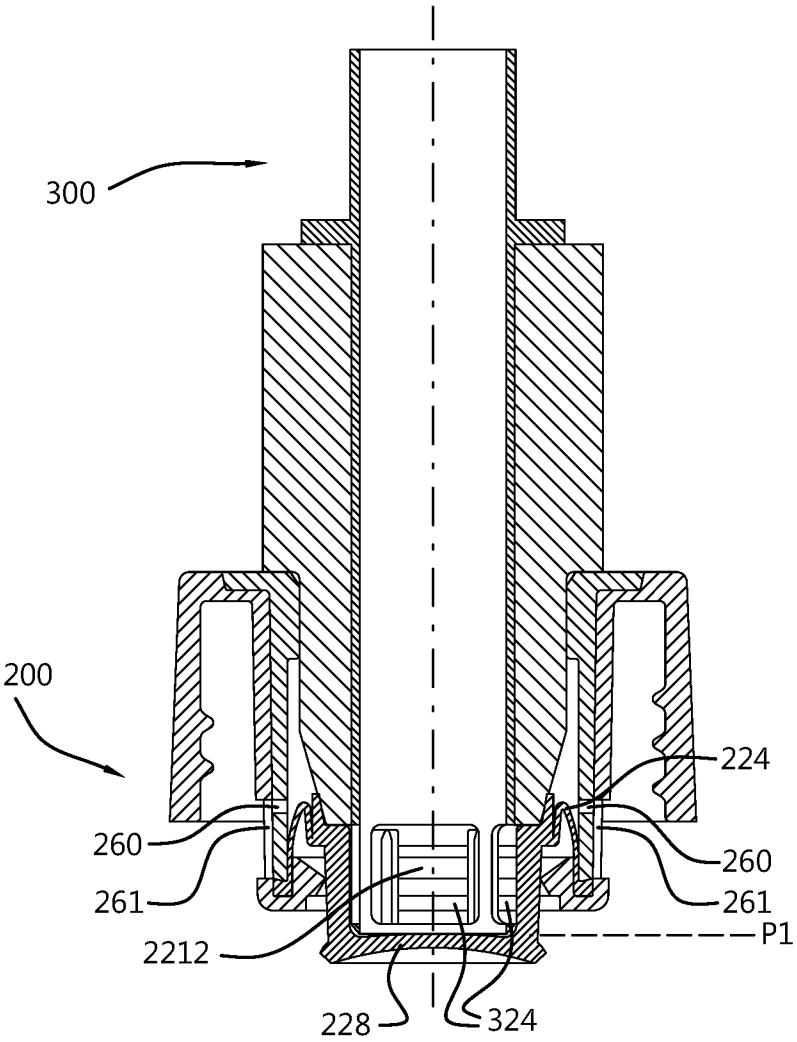
Figure 10B:
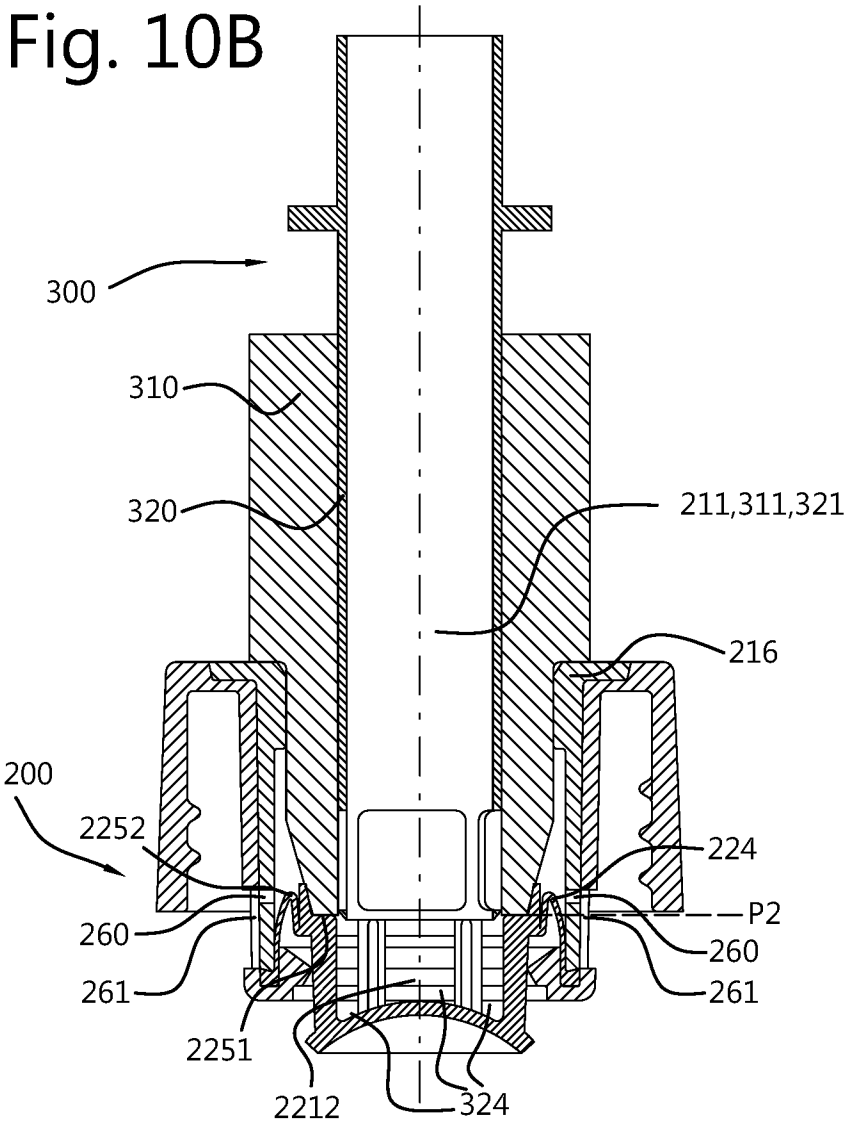
Figure 11B:
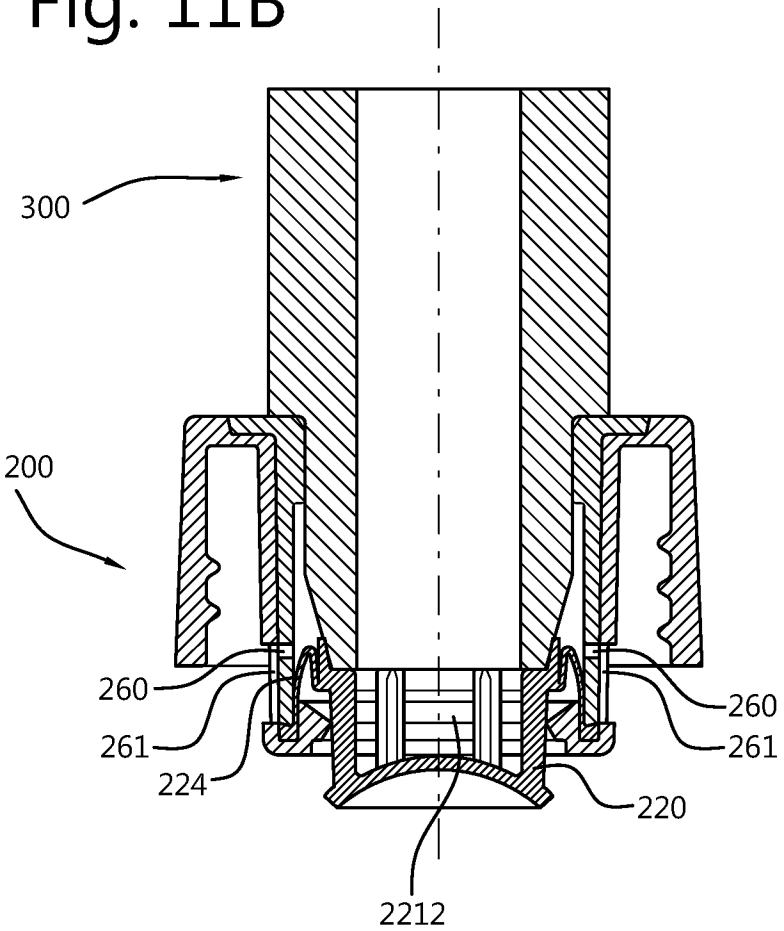
FIG. 11A and FIG. 11B are more detailed longitudinal sections of a sealing unit wherein a rigid operating tube according to the first embodiment of the sealing unit activation unit has been inserted, in a closed and open state respectively.
Figure 11A:
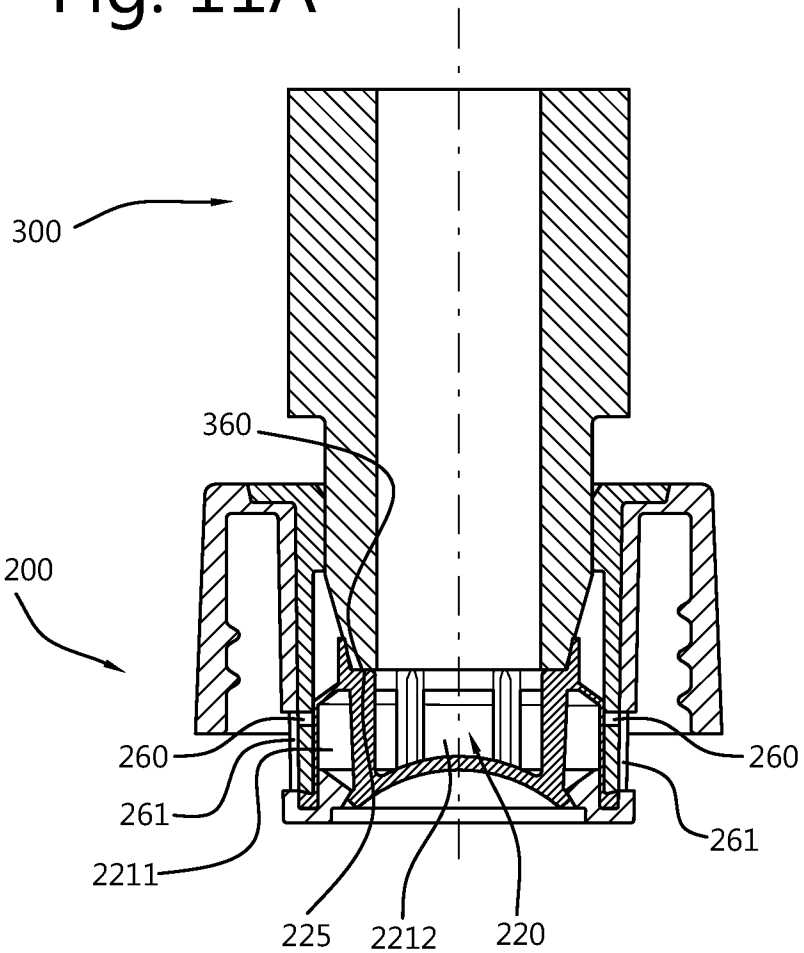

FIGS. 10A-10C and 11A-11B show embodiments of a sealing unit 200 in combination with a sealing unit activation unit 300, for instance in FIGS. 10A-10C the earlier-mentioned rigid operating (outer) tube 310 and the further, rigid inner tube 320 (cf. FIG. 5B), and in FIG. 11A-11B with a rigid operating tube 410 in case the sealing unit activation unit 300 is configured to form a dispensing unit 400, in various stages of operation. FIGS. 10A-10B show stages of a filling or refilling operation while FIGS. 11A-11B show stages of a dispensing operation (or, in other words, a pouring operation).

For filling or refilling it may be preferred to exert more detailed control over liquid flow, for example to prevent liquid which is present inside the second liquid passage 311 of the rigid operating tube 301 before or after a liquid flow is actively induced by the person or device using the sealing unit activation unit 300 from flowing into the container in an uncontrolled manner, which might result in fouling or spoilage. This may be necessary because during filling or refilling, as well as shortly before and after filling or refilling, a higher or lower liquid pressure may be present in the second liquid passage 311 of the sealing unit activation unit 300 than in other parts of the assembly.

At least for these reasons it may be preferred that the inner tube 320 is present since the inner tube 320 may be used to selectively keep the second liquid passage 311 (which may be under pressure) closed until the valve is in its fully open position.

It is noted that the figures only show the stages of operation for selectively allowing liquid flow. In order to actually induce liquid flow in a desired direction, further or parallel stages of operation may be required. For example, it may be required to change the orientation of the connected sealing units and/or to apply active propelling or suction forces to the liquid by a user, that is, a person or device using the sealing unit activation unit 300, by additional portions of the sealing unit activation unit 300 or by a connected device. Such stages, portions, or devices are not shown in the figures.

Firstly, the sealing unit activation unit 300 is inserted into the sealing unit 200 such that the rigid operating tube 310 is located inside the first liquid passage 211 and the free end of the rigid operating tube 310 comes to rest against the force receiving part 225 of the valve 220, in particular against the ring-shaped flat surface 2251 of the force receiving part 225 (cf. FIG. 2B).

Secondly, the rigid operating tube 310 is moved further in axial direction into the sealing unit 200, thereby exerting an external axial force onto the force receiving part 225 of the valve so that the valve is moved (against the spring action of the valve skirt portion 219) from the closed position of FIG. 10A to the open position of FIG. 10B. Both the radial side openings of the valve 200 for the liquid flow and the air flow openings 259 of the tubular attachment element 230 and the tubular interface element 215 for the air flow are now open. However, the radial side openings 328 in the inner tube 320 of the sealing unit activation unit 300 are still covered by the rigid operating (outer) tube 310 so that still no liquid is flowing into the container.

Thirdly, the rigid inner tube 320 is moved in axial direction relative to the outer tube 310 so that the radial side openings 328 of the inner tube 320 are uncovered. This situation is shown in FIG. 10C so that now any liquid from a filling station may flow into the container.

Once the container is sufficiently filled, the operation continues in the opposite order. First the inner tube 320 is pulled back to close of the radial side openings 328. Then the outer tube 310 is pulled back so as to allow the valve 200 the return to its closed position (under influence of the spring action of the valve skirt 219). Finally, the outer tube 310 (with the inner tube 320 located therein) is removed from the sealing unit 200.

Figure 12:
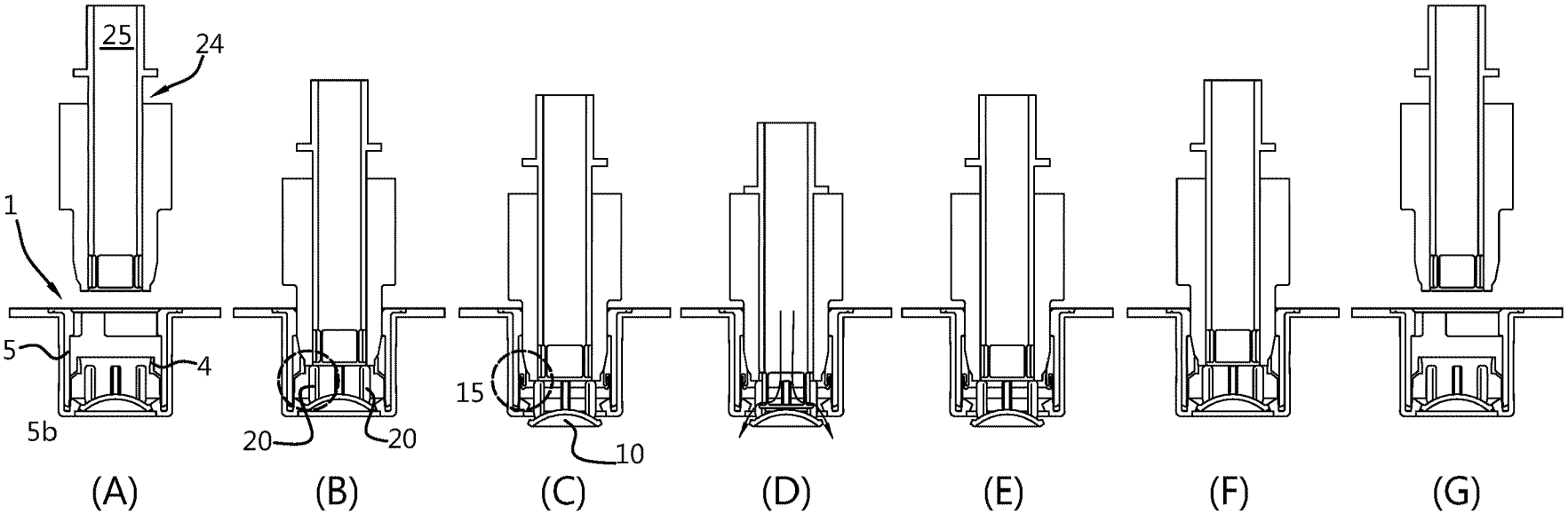
FIG. 12 denotes various stages of a filling operation.
Figure 13:
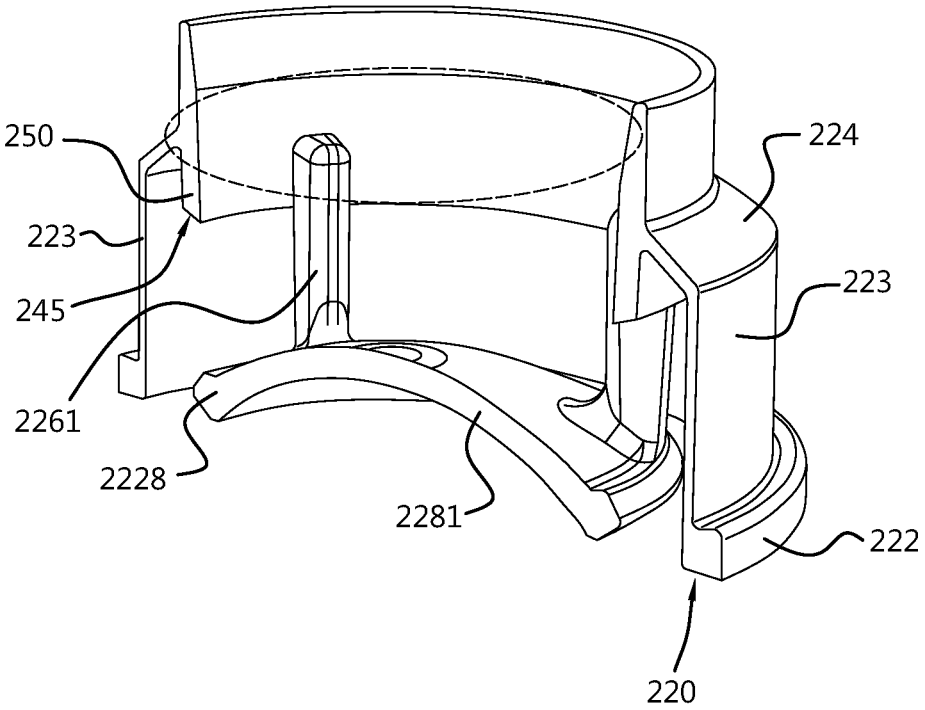
FIG. 13 is a partly cut-away view in perspective of a further embodiment of a sealing unit.

A complete sequence of steps is also shown in FIG. 12.

The sequence of operational steps in case of dispensing liquid from the container is quite similar. FIG. 11A shows a rigid operating tube 410 of a dispensing unit 400 that is inserted into the flow passage 211. The valve 200 is still in its closed position. FIG. 11B shows the same rigid operating tube 410 inserted further into the passage, causing the valve 200 to be moved to the open position wherein liquid may flow out of the container and air may flow into the container (to at least partially compensate for the volume of the liquid removed from the container).

Figure 14:
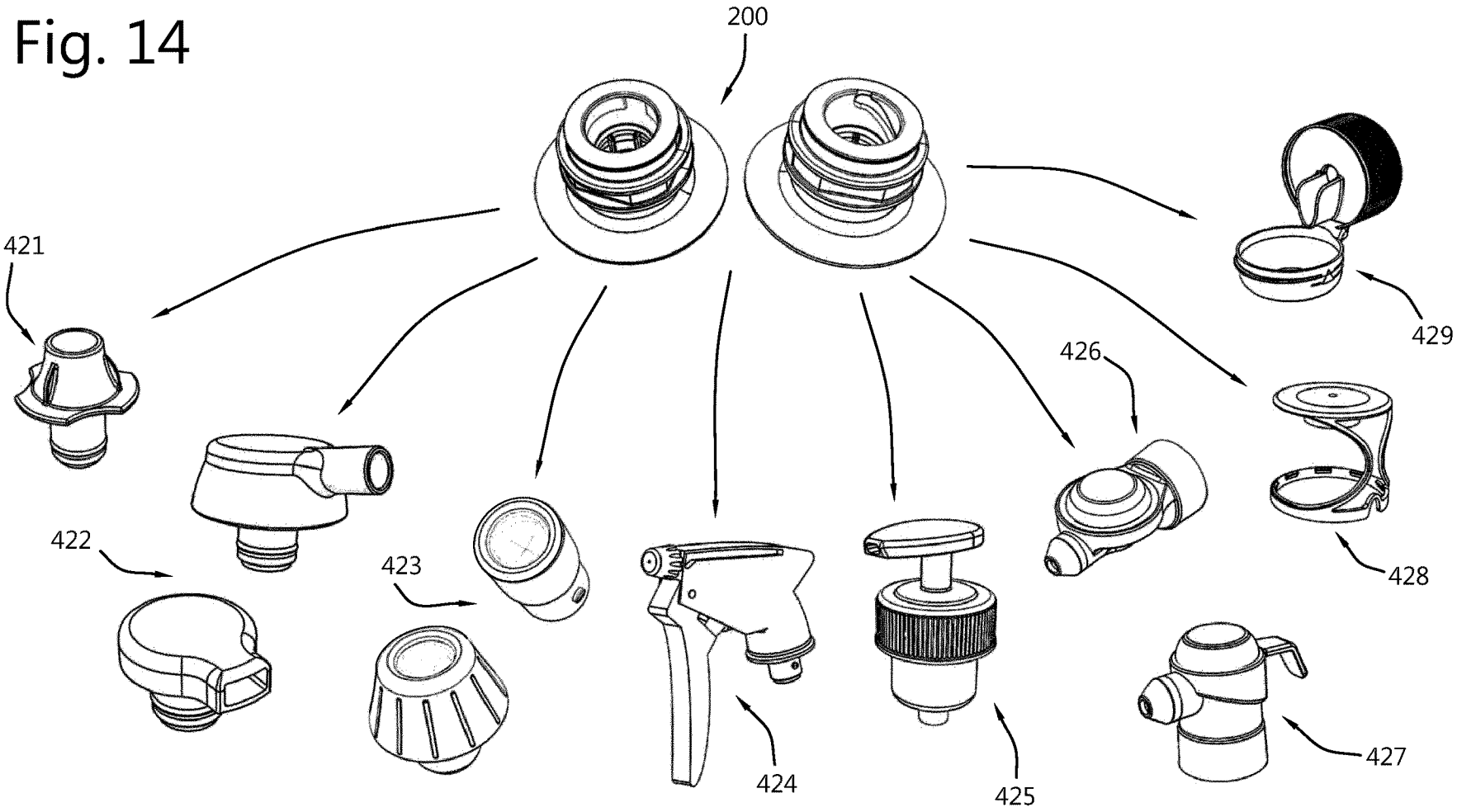
FIG. 14 are views of several examples of dispensing units that can be used in combination with a sealing unit according to the present disclosure.

Referring to FIG. 14 the sealing unit 200 may be used in combination with various types of dispensing units 400, viz. a refill nozzle 421, a dispensing nozzle 422, a slit valve dispenser nozzle 423, a trigger dispenser 424, a volumetric pump 425, a dispensing pump 426, a 90° dispensing pump 427, a tethered dust cap 428, and/or a spoonfuls ladle 429.

It is to be understood that this disclosure is not limited to particular aspects described, and, therefore, may vary. It is also to be understood that the terminology used herein is for the purpose of describing particular aspects only, and is not intended to be limiting, since the scope of the claimed subject-matter will be limited only by the appended claims.

The invention claimed is:

1. A sealing unit for selectively sealing and opening a container liquid opening in a liquid container for holding a liquid, the sealing unit comprising:

a tubular element comprising a liquid passage extending in an axial direction between an inner opening and an outer opening, wherein the tubular element is configured to be fixedly positioned relative to the container liquid opening so as to provide a liquid connection between the inner opening of the tubular element and an interior of the liquid container via the container liquid opening;

a valve arranged inside the liquid passage of the tubular element, the valve comprising:

a tubular valve portion that is configured to be axially movable inside the liquid passage relative to the tubular element between a closed position wherein the tubular valve portion seals off the liquid passage and an open position wherein the tubular valve portion leaves the liquid passage open; and a valve skirt portion extending along a circumference of the tubular valve portion, wherein the valve skirt portion is at a first side connected to or integrally formed with the tubular valve portion and at a second side connected or connectable to the tubular element, the valve skirt portion comprising a flexible skirt part configured to bend when the tubular valve portion is moved from the closed position to the open position under influence of an external axial force exerted on a force receiving part of the tubular valve portion and to urge the tubular valve portion back from the open position to the closed position when the external axial force is removed or reduced;

wherein the tubular element further comprises at least one air flow opening arranged to provide an air passage and wherein the at least one air flow opening is arranged to be covered by the valve skirt portion when the tubular valve portion is in the closed position and to be left open by the valve skirt portion when the tubular valve portion is in the open position.

2. The sealing unit according to claim 1, wherein the at least one air flow opening is arranged in a cylindrical wall of the tubular element at such a position that in an operational state and with the tubular valve portion in the open position the at least one air flow opening allows air to flow between the interior of the liquid container and the liquid passage of the tubular element.

3. The sealing unit according to claim 1, wherein the tubular element comprises a tubular attachment element inside which a tubular interface element is arranged and wherein the at least one air flow opening in the tubular element comprise one or more interface element openings in the tubular interface element of the tubular element and one or more attachment element openings in the tubular attachment element of the tubular element.

4. The sealing unit according to claim 3, wherein the tubular interface element comprises a cylindrical wall with an outer diameter and the tubular attachment element comprises a cylindrical wall with an inner diameter, wherein the outer diameter is equal or smaller than the inner diameter.

5. The sealing unit according to claim 3, wherein the valve skirt portion is configured to releasably connected to the tubular interface element of the tubular element.

6. The sealing unit according to claim 3, wherein the valve skirt portion comprises at its second side a fixing portion configured to hook behind a free end of the tubular interface element to connect the valve to the tubular element.

7. The sealing unit according to claim 3, wherein at least one of the interface element openings at least partially overlaps at least one of the attachment element openings when the tubular interface element is arranged in the tubular attachment element.

8. The sealing unit according to claim 3, further comprising an additional air passage extending between an attachment element opening and an interface element opening.

9. The sealing unit according to claim 3, wherein the tubular element comprises a closing portion radially surrounding the inner opening of the tubular element configured for receiving an end of the tubular valve portion to selectively close off and open the liquid passage.

10. The sealing unit according to claim 1, wherein an end of the tubular valve portion comprises a circumferential radial flange shaped to sealingly rest against a closing portion of the tubular element when the valve is in the closed position, to seal off the liquid passage.

11. The sealing unit according to claim 10, wherein the tubular valve portion comprises a circumferential contact surface positioned remote from the circumferential radial flange configured to sealingly rest against the closing portion of the tubular element when the valve is in the open position.

12. The sealing unit according to claim 11, wherein the tubular valve portion comprises one or more side openings arranged axially between the circumferential radial flange and a circumferential contact surface.

13. The sealing unit according to claim 1, wherein the tubular valve portion comprises a skirt portion.

14. The sealing unit according to claim 1, wherein;

the tubular valve portion comprises a tube that is closed at one end with an end wall, and one or more side openings are provided in a side wall of the tube.

15. The sealing unit according to claim 14, wherein inside the tube a central cavity and outside the tube, between the tube and the valve skirt portion, a radially outer cavity is defined, wherein the one or more side openings are arranged between the central cavity and the radially outer cavity and wherein the valve is further configured to selectively allow liquid flow between the inner opening and the outer opening of the tubular element via the central cavity and the radially outer cavity when the valve is in the open position.

16. The sealing unit according to claim 1, wherein the valve skirt portion is made of a material that is more flexible than a material of remaining portions of the valve.

17. The sealing unit according to claim 1, wherein the tubular element is configured to removably receive in the liquid passage a rigid operating tube of a sealing unit activation unit, the rigid operating tube configured to be axially movable inside the liquid passage of the tubular element so as to engage the force receiving part of the tubular valve portion and apply the external axial force to displace the valve to the open position.

18. The sealing unit according to claim 1, wherein the force receiving part of the tubular valve portion of the valve comprises a ring-shaped flat surface which is perpendicular to the axial direction of the tubular element.

19. The sealing unit according to claim 1, wherein the tubular element comprises connecting means configured to releasably connect the sealing unit to a fitment formed with or connected to the liquid container so as to fixedly position the tubular element relative to the container liquid opening.

20. The sealing unit according to claim 1, wherein the tubular element is permanently connected to a fitment formed with or connected to the liquid container so as to fixedly position the tubular element relative to the container liquid opening.

21. A sealing unit activation unit for selectively operating a sealing unit according to claim 1, the sealing unit activation unit comprising:

a rigid operating tube configured to be inserted into the liquid passage of the tubular element, wherein;

the rigid operating tube comprises an operating tube liquid passage extending in an axial direction between an inner opening and an outer opening, and the rigid operating tube is configured to be inserted in the liquid passage of the tubular element of the sealing unit so as to apply an external axial force on a force receiving part of the valve, thereby moving the valve from a closed position to an open position.

22. A method of selectively sealing and opening a container liquid opening in a liquid container provided with a sealing unit according to claim 1, the method comprising:

applying an external force to the tubular valve portion arranged inside a liquid passage of a tubular element to cause the tubular valve portion to move in an axial direction between a closed position wherein the tubular valve portion seals off both a liquid passage and an air passage and an open position wherein both the liquid passage and the air passage are open, wherein movement of the tubular valve portion further causes bending of the flexible skirt part;

reducing the external force applied to the tubular valve portion so that the bent flexible skirt part returns to its original shape thereby urging the tubular valve portion back from the open position to the closed position.

* * * * *